US009907723B2

(12) United States Patent
Bisceglia et al.

(10) Patent No.: US 9,907,723 B2
(45) Date of Patent: Mar. 6, 2018

(54) UNIVERSAL USER ASSIST SEAT FOR WALKERS

(71) Applicants: John Bisceglia, Bolton Landing, NY (US); Michael Massarone, Glenville, NY (US)

(72) Inventors: John Bisceglia, Bolton Landing, NY (US); Michael Massarone, Glenville, NY (US)

( * ) Notice: Subject to any disclaimer, the term of this patent is extended or adjusted under 35 U.S.C. 154(b) by 0 days.

(21) Appl. No.: 15/663,267

(22) Filed: Jul. 28, 2017

(65) Prior Publication Data

US 2018/0028392 A1 Feb. 1, 2018

Related U.S. Application Data

(60) Provisional application No. 62/367,889, filed on Jul. 28, 2016.

(51) Int. Cl.
*A61H 3/04* (2006.01)

(52) U.S. Cl.
CPC ..... *A61H 3/04* (2013.01); *A61H 2003/046* (2013.01)

(58) Field of Classification Search
CPC ... B62M 1/00; B62B 3/00; A61H 3/04; A61H 3/00; A61H 2201/0161; A61H 2003/006
See application file for complete search history.

(56) References Cited

U.S. PATENT DOCUMENTS

| | | | | |
|---|---|---|---|---|
| 4,941,708 | A | 7/1990 | Heffner | |
| 4,979,726 | A | 12/1990 | Geraci | |
| 5,320,122 | A | 6/1994 | Jacobson, II et al. | |
| 7,669,863 | B2 * | 3/2010 | Steiner | A61G 5/14 280/250.1 |
| 8,360,518 | B2 | 1/2013 | Braaten | |
| 2010/0219668 | A1 * | 9/2010 | Nelson | A61G 5/14 297/330 |

* cited by examiner

*Primary Examiner* — John D Walters
*Assistant Examiner* — James J Triggs
(74) *Attorney, Agent, or Firm* — Heslin Rothenberg Farley & Mesiti PC; Kristian E. Ziegler

(57) ABSTRACT

The present disclosure provides a universal user assist seat for use with walkers and seating platforms, and walker with said seat. The universal user assist seat may include a base portion, an engagement portion pivotably coupled to an upper surface of the base for engaging a user when a user sits thereon, and a lifting mechanism that provides an assist force to the engagement portion that biases the engagement portion in an upward position from the base. The universal user assist seat may also include at least one attachment mechanism that removably and rotatably couples the base of the user assist seat to at least one of a front cross-member and a rear cross-member of a frame of a walker. The walker may include frame comprising a plurality of leg portions extending between ground engagement portions and handle portions, and the front and rear cross-members.

20 Claims, 30 Drawing Sheets

UNIVERSAL USER ASSIST SEAT FOR WALKERS

FIELD OF THE INVENTION

The present disclosure is generally directed to walkers. More particularly, the present disclosure is directed to rollator type walkers with user assist seats.

BACKGROUND OF THE INVENTION

Many individuals suffer from physical ailments that result in reduced mobility. Medical conditions such as arthritis, osteoporosis, stroke, paralysis, loss of strength and/or agility, injury and other conditions, for example, may make it difficult for some individuals to move their limbs. Reduced mobility of the legs and/or back is particularly common. When changing from a sitting position to a standing position or vice versa, strain is placed on an individual's back, shoulders, arms, and legs, and a particular amount of strength and agility is needed. It can be painful and/or physically difficult for some individuals to sit and/or stand.

To assist users in walking and/or sitting up and down, walkers or walking frames are a common tool that provides manual support for the user. A walker typically consists of a relatively lightweight frame that is about waist high, approximately about one foot deep and slightly wider than the particular user, though they are commonly sized for a particular user. Many walkers are height adjustable (e.g., include adjustable leg members) such that handle portions of the walker are set at a height that is comfortable for the particular user and will allow the particular user to maintain a slight bend in their arms.

Walkers typically include four legs arranged in a quadrilateral and connected to elevated elongated handlebars or grips, and support members extending between various aspects to ensure rigidity and strength. Many walkers include front and rear cross-members extending between a pair of front legs and a pair of the rear legs, respectively. In this way, walkers typically are formed into a "U" shape such that the user is positioned at least partially within the opening between the handlebars and the rear two legs while in use. Some walkers are foldable such that the rear legs and the front legs fold or swing toward each other. In this way, foldable walkers can "fold" into a substantially flat arrangement (from the "U" shape) for storage and/or transportation.

In use, a user walks with the frame of the walker surrounding their front and left and right sides (at least partially), with their hands engaging the handlebars or top of the sides of the frame. Traditionally, a traditional walker is picked up by the user and placed a short distance ahead of the user. The user then walks to the repositioned walker and repeats the process. In this way, the walker assists the user in walking. Some walkers include wheels or other mechanism at the bottom of the pair of front legs configured such that the walker can be rolled, pushed otherwise moved ahead of the user without necessarily being picked up. Walkers that include wheels on only the front pair of legs are typically referred to as wheeled walkers.

Some walkers have wheels on all four legs (i.e., the front pair of legs and the back pair of legs) and are typically more sophisticated and sturdier than conventional walkers and wheeled walkers. Such walkers are commonly referred to as rollators. Rollators are often adjustable in height and are light-weight, and are designed to fold for ease of storage and transport. Rollators typically have handle bars, manually engageable hand brakes associated with the handlebars configured to selectively brake at least some of the wheels, and a seat. The hand brakes may be configured to be manually lifted or pushed downward to prevent or slow rotation of the associated wheels and thereby stop or slow movement of the rollator. The brakes can also be used in maneuvering the rollator, such as by braking one side while turning the wheeled walker towards that side a much tighter turning radius can be achieved.

As noted above, some rollators include a built-in seat. The seat of a rollator is typically fixed to the rollator laterally between the left and right hand legs to allow a user to sit when needed or desired. However, users of rollators often have reduced strength, agility, balance or other physical shortcoming or difficulty that prevents them from walking safely un-assisted—hence why they are using a walker. These same physical difficulties also make it difficult to stand and sit. As such, typical users of rollators have difficulty utilizing the seat thereof and/or would benefit from devices and systems that aid in sitting and standing.

Therefore, rollator type walkers with a seat that helps or assists a user to sit on and/or stand up from the seat is desirable. Further, user assist seats that can be selectively utilized on both rollators and on existing seating devices, such as on furniture, are desirable.

SUMMARY OF THE INVENTION

In one aspect, the present disclosure provides a connector system for connecting a lifting or assist seat to a walker, such as rollators or rollator type walkers. The connector system may include a base that is securable to an upper portion of a walker, such as to front and rear cross-members thereof, via at least one connection or attachment mechanism (e.g., a plurality of connection mechanisms) disposed thereon, such as removable clip mechanisms. The lifting seat may be disposed on an upper side of the base and connected thereto via a hinge or pivotable connection. The lifting seat may include a lifting mechanism, such hydraulics or a gas spring, disposed under the lifting seat that is configured to assist with the raising of the seat upward from the base to help a user move form a sitting position to a standing position (and potentially the lowering of the seat downward toward the base). The upward (and potentially downward) motion of the seat may be configured to assist a user with standing up (and potentially sitting down) from a seated position on the seat (and sitting down onto the seat from a standing position) by applying a corresponding "assisting" force to the buttocks of the user. For example, the lifting mechanism may be configured to bias the lifting seat into a raised or elevated angular positioned from a lowered more-horizontal position with respect to the base and/or walker. In this way, as a user sits on the seat, the lifting mechanism may act to "help" the user to slowly lower or pivot the seat from the raised positioned to the lowered position (and thereby sit down) by providing a supporting force against the user. Similarly, as the user stands up from a sitting position on the seat, the lifting mechanism may "help" the user raise or pivot the seat from the lowered positioned to the raised position (and thereby stand up) by providing a supporting force against the user.

The connector system may further allow the lifting seat to be removed from at least a portion of the walker, such as from one of the front and rear cross-members. For example, the connection mechanisms may allow the lifting seat to pivot or rotate away from a portion of the frame of the rollator type walker, such as from one of the front and rear cross-members. In this way, the lifting seat may be repositionable between an activated position and a storage position with the lifting removed from at least a portion of the rollator type walker. In the storage position, the walker may be able to be folded or otherwise collapsed. As another example, the connector system may removably couple the lifting seat to the walker, such as from the front and rear cross-members of the walker.

The present disclosure also provides walkers, such as rollators or rollator type walkers, with a lifting or assist seat connected thereto, as described above.

The present disclosure also provides lifting or assist seats that are configured to selectively be utilized on walkers, such as rollators or rollator type walkers, and on existing seating devices, mechanisms or spaces. For example, the attachment mechanisms of the lifting or assist seat described above may be removably attached or coupled to the base. As such, the base, lifting seat and lifting mechanism may be detached from the attachment mechanisms, and thereby a walker, and positioned on a seat or seating space to assist the user in sitting thereon and/or standing up therefrom. As another example, the attachment mechanisms may be configured to removably couple to a walker, such as to the front and/or rear cross-members thereof, and be repositioned from the base such that they do not interfere with use of the base on a seat or seating space. In some embodiments, the attachment mechanisms may be configured to extend from the base and removably couple to front and/or rear cross-members of a walker, walkers, such as rollators or rollator type walkers, and pivot or rotate from such an orientation after being detached from the front and/or rear cross-members into one or more corresponding cavities such that the base provides a relatively flat surface for unconstructive engagement onto an existing seat or seating space.

In one aspect, the present disclosure provides a walker comprising a frame comprising a plurality of leg portions extending between ground engagement portions and handle portions, and front and rear cross-members. The walker also comprises a user assist seat comprising a base, an engagement portion pivotably coupled to the base for engaging a user sitting thereon, and a lifting mechanism configured to provide an assist force to the engagement portion that pivotably biases the engagement portion upward from the base. The walker further comprises at least one attachment mechanism that removably and rotatably couples the base of the user assist seat to at least one of the front and rear cross-members.

In some embodiments, the at least one attachment mechanism is removably coupled to the base of the user assist seat. In some such embodiments, an underside of the base of the user assist seat forms a substantially planar surface when the at least one attachment mechanism is decoupled from the base. In some other such embodiments, the at least one attachment mechanism extends through an aperture in the base and comprises a base portion positioned on an underside of the base and a nut portion rotatable coupled with the base portion positioned on a top side of the base to removably couple the at least one attachment mechanism and the assist seat. In some such embodiments, the aperture in the base is of a non-circular shape, and the nut portion of the at least one attachment mechanism is the same shape as the aperture. In some other such embodiments, the base includes a plurality of apertures. In some other such embodiments, the aperture is a slot. In some such embodiments, a portion of the base proximate to the slot on at least one of the underside and top side of the base includes a surface texture.

In some embodiments, the at least one attachment mechanism includes a pair of finger portions independently slidable within a slot in the underside of the base of the assist seat. In some embodiments, the at least one attachment mechanism includes an engagement member that is slidable within a slot in the underside of the base of the assist seat, and the underside of the base of the assist seat includes at least one recesses configured to accept at least one of the front and rear cross-member therein. In some embodiments, the at least one attachment mechanism comprises a mount with at least one outwardly biased tab with a lip, and wherein the base includes an aperture configured to accept the mount therein such that the lip engages the base. In some embodiments, the at least one attachment mechanism includes flexible portions configured to removably couple to the at least one of the front and rear cross-members.

In some embodiments, the at least one attachment mechanism removably and rotatably couples the base of the user assist seat to the front cross-member. In some such embodiments, an underside of the base rests upon the rear cross-member. In some embodiments, the walker is a rollator type walker with at least one of the ground engagement portions comprising a wheel. In some embodiments, the front cross-member extends between left and right front leg portions, and the rear-cross member extends between left and right rear leg portions.

In another aspect, the present disclosure provides a universal user assist seat for use with walkers and seating substrates. The assist seat comprises a base portion, and an engagement portion pivotably coupled to an upper surface of the base for engaging a user when a user sits thereon. The assist seat further comprises a lifting mechanism that provides an assist force to the engagement portion that biases the engagement portion in an upward position from the base. The assist seat also comprises at least one attachment mechanism configured to removably and rotatably couple the base of the user assist seat to at least one of a front cross-member and a rear cross-member of a frame of a walker.

In some embodiments, the at least one attachment mechanism is removably coupled to the base of the user assist seat. In some such embodiments, an underside of the base of the user assist seat forms a substantially planar surface when the at least one attachment mechanism is decoupled from the base for use with a seating substrate. In some other such embodiments, the at least one attachment mechanism extends through an aperture in the base and comprises a base portion positioned on an underside of the base and a nut portion rotatable coupled with the base portion positioned on a top side of the base to removably couple the at least one attachment mechanism and the assist seat. In some such embodiments, the aperture in the base is of a non-circular shape and the nut portion of the at least one attachment mechanism is the substantially the same shape as the aperture, and the base includes a plurality of apertures.

These and other objects, features and advantages of this disclosure will become apparent from the following detailed description of the various aspects of the disclosure taken in conjunction with the accompanying drawings.

BRIEF DESCRIPTION OF THE DRAWINGS

For the purposes of illustrating the walkers, list assist seats and related methods described herein, there is shown herein illustrative embodiments. These illustrative embodiments are in no way limiting in terms of the precise arrangement and operation of the disclosed walkers, list assist seats and related methods and other similar embodiments are envisioned within the spirit and scope of the present disclosure.

DETAILED DESCRIPTION

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

Figure 1:
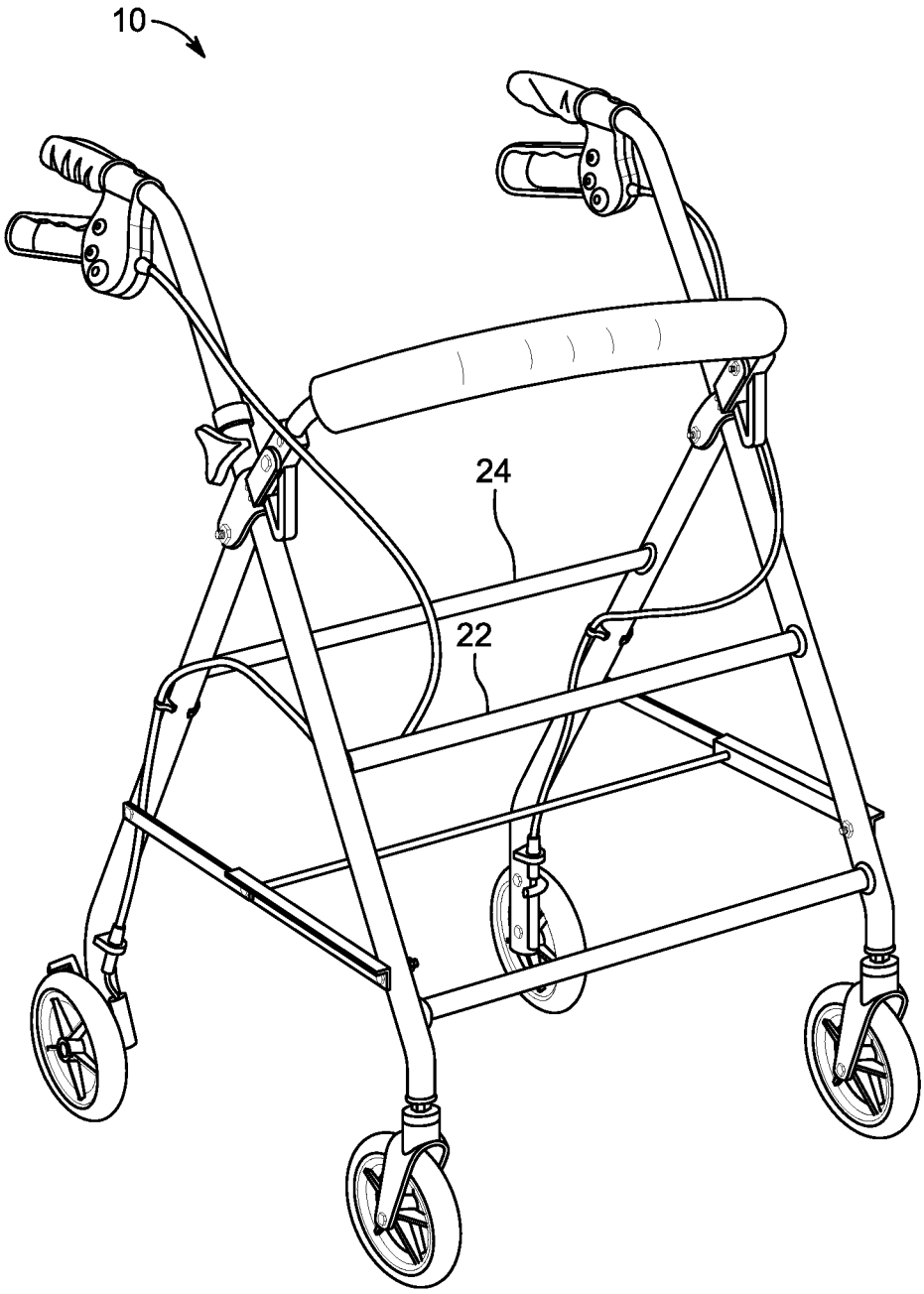
FIG. 1 is a front perspective view of an exemplary prior art rollator type walker.
Figure 2:
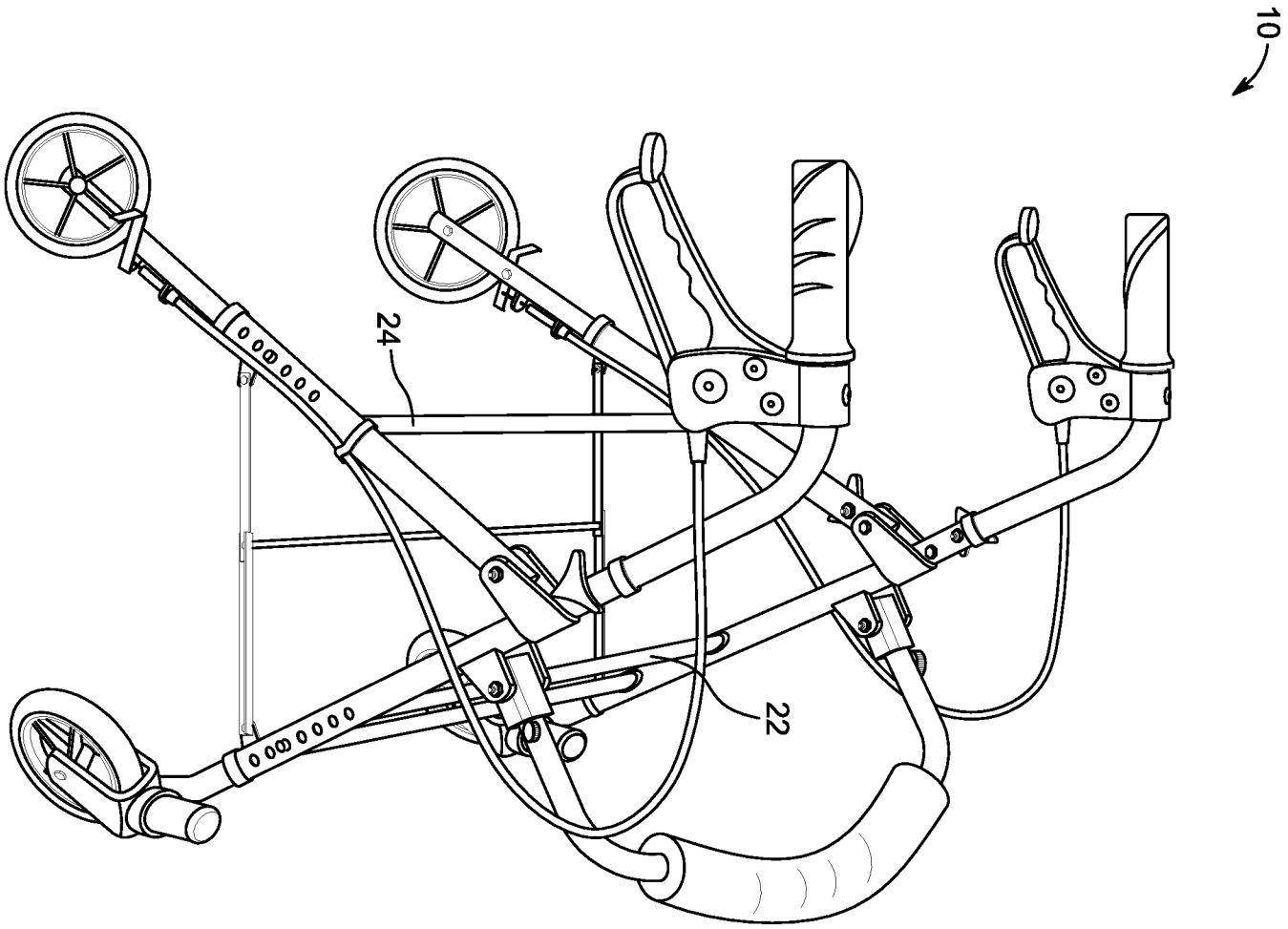
FIG. 2 is a side perspective view of the exemplary rollator of FIG. 1.
Figure 3:
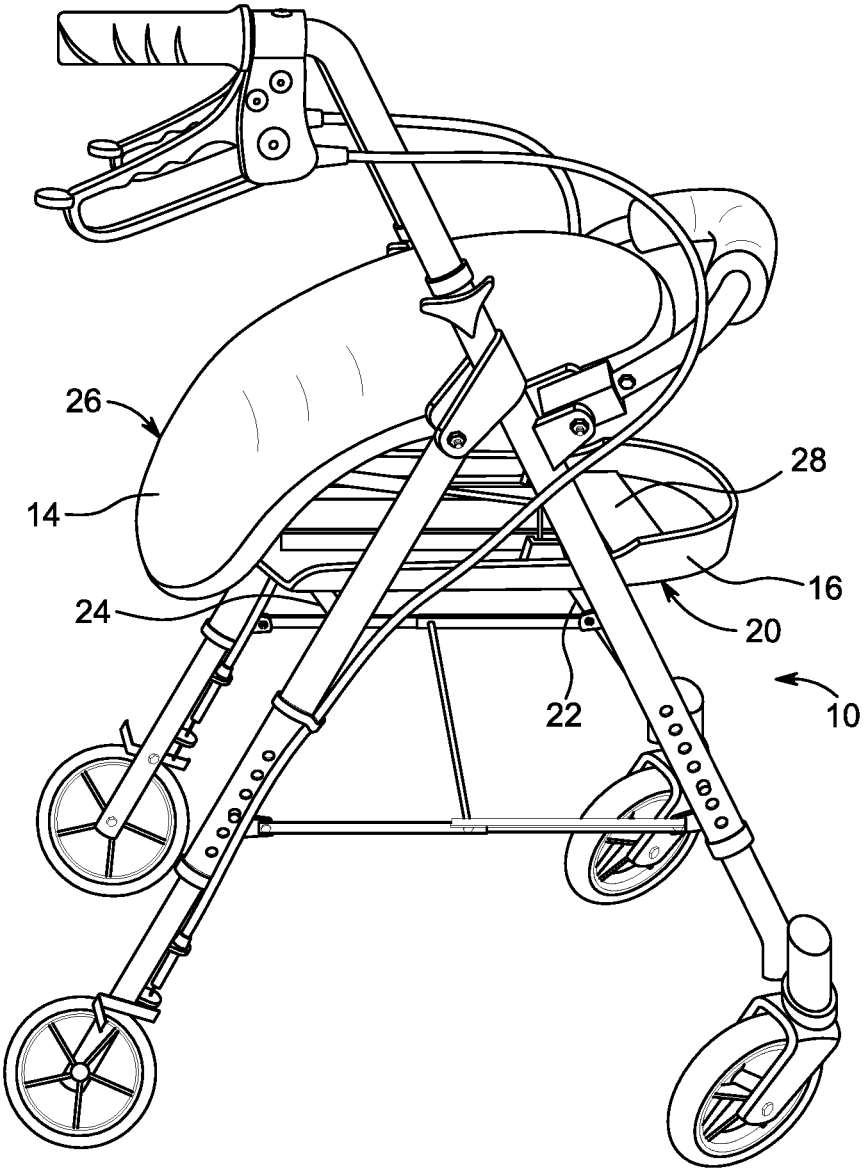
FIG. 3 is a side perspective view of an exemplary rollator type walker and user assist seat according to the present disclosure.

As shown in FIGS. 1 and 2, a walker 10, such as rollator type walker, may include a frame with a plurality of leg portions extending between feet or wheels that engage the ground during use and handle portions which the user grasps to utilize the walker. Many different walkers exist. For example, U.S. Pat. No. 5,865,065 to Chiu, U.S. Pat. No. 6,338,355 to Cheng, U.S. Pat. No. 6,481,730 to Sung, U.S. Pat. No. 7,052,030 to Serham, U.S. Pat. No. 8,434,780 to Li, and U.S. Pat. No. 8,840,124 to Serham disclose several rollator type walkers. Some walkers may be configured to fold or collapse into a more flat or planar arrangement as compared to a deployed or in-use configuration. Some walkers include two at least two wheels that engage the ground, and some walkers include at least two feet or free ends that engage the ground (such as a traditional non-wheeled walker, a back-wheeled walker, a front-wheeled walker, an a back and front-wheeled walker).

As shown in FIGS. 1 and 2, while the particular design and/or features of walkers may differ or vary from walker to walker, many walkers include front and rear cross-members or -bars 22, 24 extending between corresponding front and rear leg portions of the walker 10. The front and rear cross-members 22, 24 may extend substantially laterally across the width of the walker 10, and may extend substantially parallel to each other, as shown in FIGS. 1 and 2. In other embodiments, however, the front and rear cross-members 22, 24 of the walker 10 may not extend laterally between corresponding leg portions and/or may not extend substantially parallel to each other. In some embodiments, the front and rear cross-members 22, 24 of the walker 10 may be positioned along a medial portion of the height of the frame of the walker 10. The front and rear cross-members 22, 24 may be exposed or accessible from above the walker 10, such as from an area proximate to the handle portions of the walker, as shown in FIGS. 1 and 2. The front and rear cross-members 22, 24 may form part of the frame of the walker 10 and assist in providing a steady and strong platform or framework to support the user as the user utilizes the walker 10 to assist with walking, standing, sitting and other motions.

Figure 4:
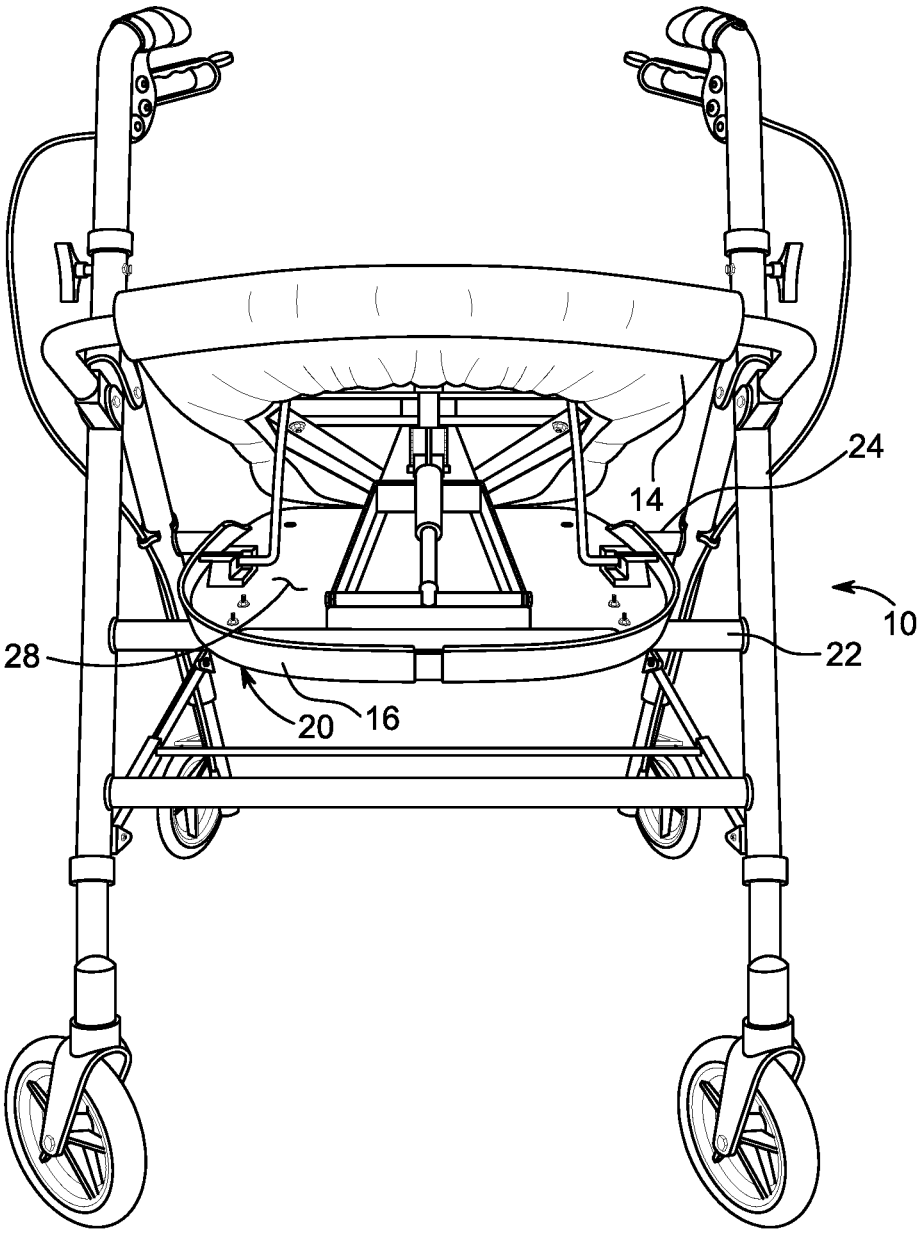
FIG. 4 is a front view of the exemplary rollator type walker and user assist seat of FIG. 3.
Figure 5:
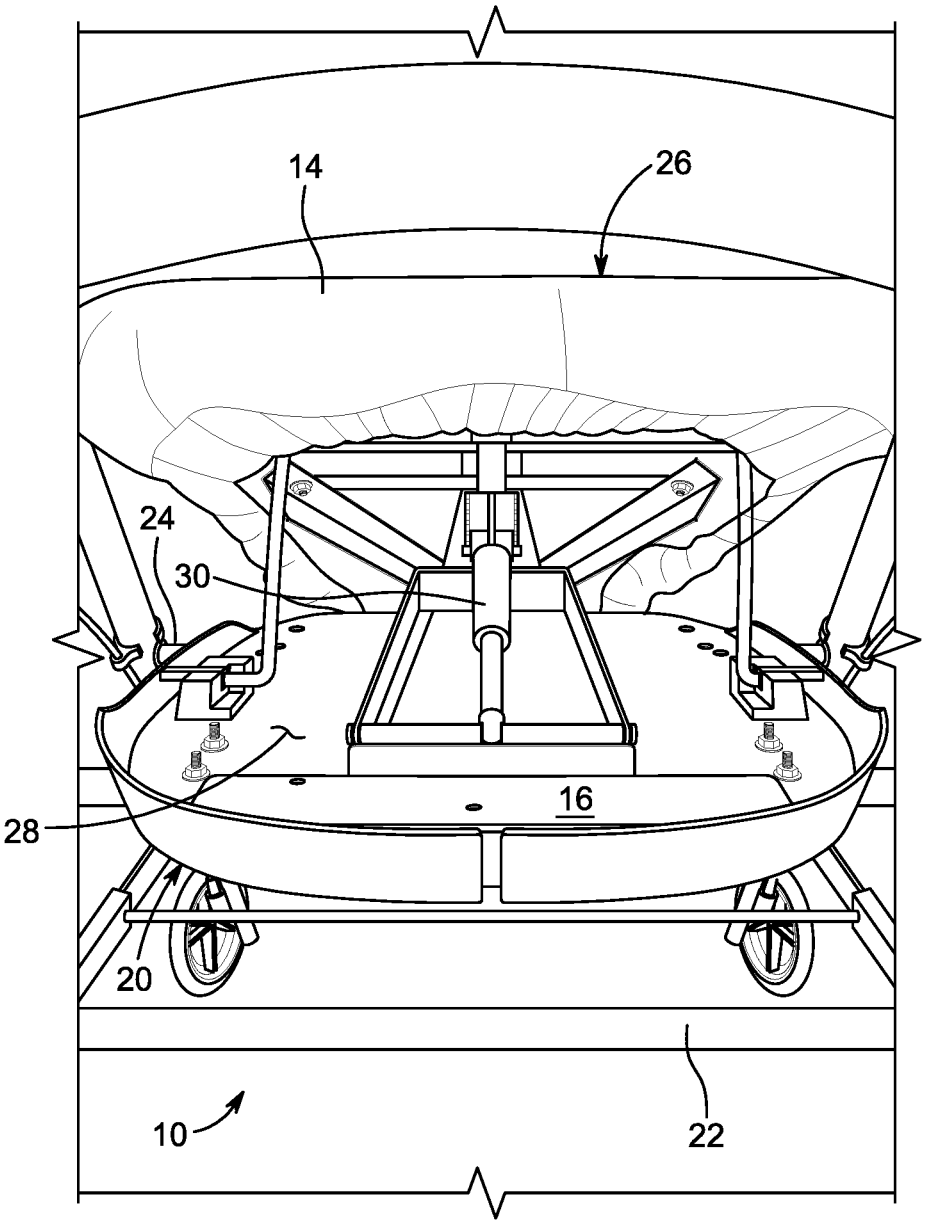
FIG. 5 is an enlarged front view of a portion of the exemplary rollator type walker and user assist seat of FIG. 3.
Figure 6:
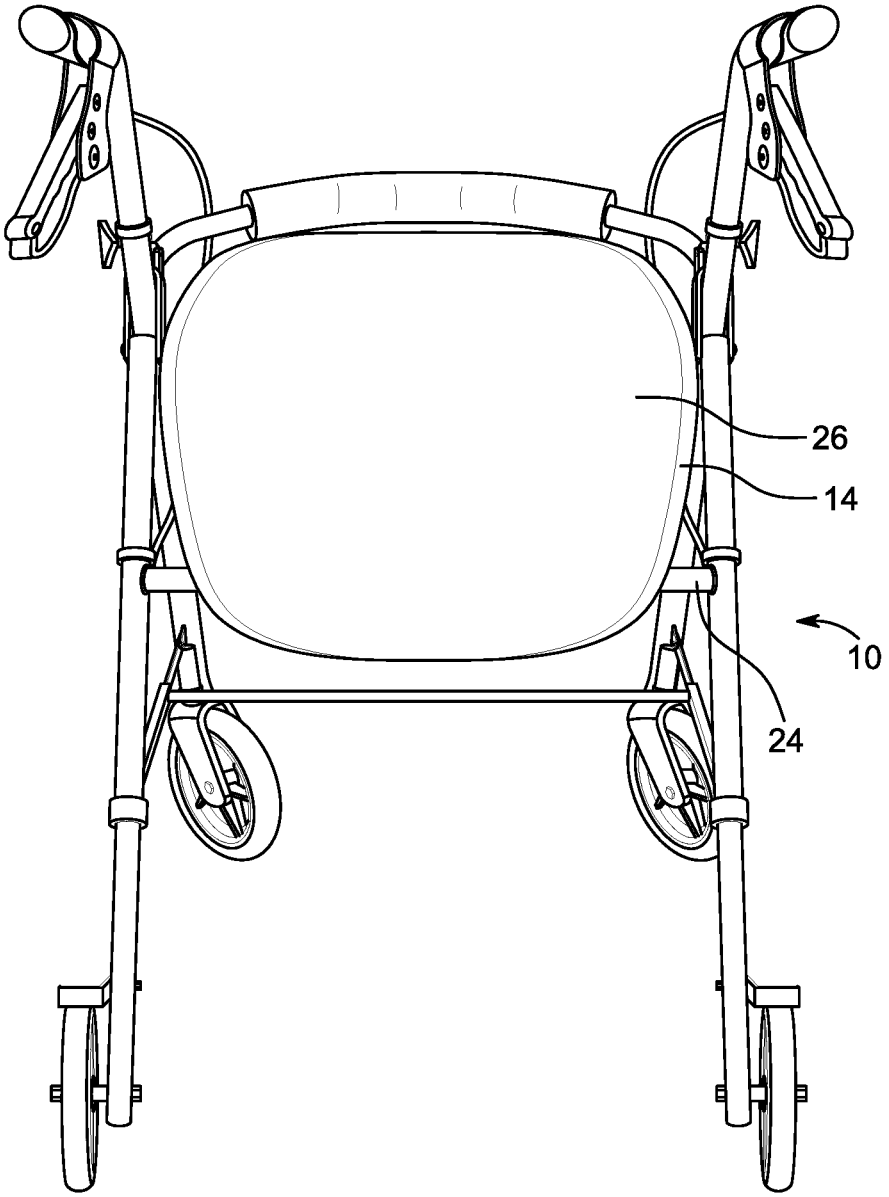
FIG. 6 is a back view of the exemplary rollator type walker and user assist seat of FIG. 3.

As shown in FIGS. 3-6, the present disclosure may provide a connector system 12 for removably (and potentially pivotably) coupling an assist seat 12 to the frame of the walker 10, such as to the front and rear cross-members 22, 24 of the walker 10. The connector system 12 may removably and/or pivotably couple a base 16 of the assist seat 14 to the front and rear cross-members 22, 24 of the walker 10 via a plurality of attachment mechanisms disposed on a substantially planar lower or bottom surface 20 thereof. The attachment mechanisms may be configured to removably couple the base 16 to at least one frame portion of the walker 10. As shown in FIGS. 3-6, the attachment mechanisms may removably attach the base 16 of the user assist seat 14 to a front cross-member 22 and/or a rear cross-member 24 of the frame of the walker 10. In some embodiments, the attachment mechanisms may removably and pivotably couple the base 16 of the assist seat 14 to the top portions or aspects of the front and rear cross-members 22, 24 of the walker 10 such that the assist seat 14 is able to be disengaged from the front cross-member 22 and pivot or rotate at least partially about the rear cross-member 24, as shown in FIG. 6. Further, the attachment mechanisms may allow the entirety of the assist seat 14 (e.g., the front and rear portions thereof) to decouple or disengage the front and rear cross-members 22, 24 of the walker 10. When decoupled from the walker 10, the assist seat 14 may be utilized on any desired seating surface or area.

The assist seat 14 may be any user assist seat or lifting seat that assists a user from sitting down into and/or standing up from a seating position on a seat portion 26 of the user assist seat 14, as shown in FIGS. 3-6. For example, the user assist seat 14 may be at least similar to a user assist seat of U.S. Pat. No. 5,316,370 to Newman, which is expressly incorporated herein by reference in its entirety. The seat portion, cushion or seat engagement portion 26 of the assist seat 14 may be coupled to an upper side 28 of the base 16 of the seat 14 via a pivotable connection, such as via a hinge and lift mechanism 30 for example, as shown in FIGS. 4 and 5. The lifting mechanism 30 may be disposed between the upper side 28 of the base 16 and the bottom side of the seat portion 26, as shown in FIGS. 4 and 5. The lifting mechanism 30 may be any mechanism configured to assist with the raising (e.g., pivoting) of the seat portion 26 upward from the base 16 and the lowering (e.g., pivoting) of the seat portion 26 downward toward the base 16, such a spring, hydraulic cylinder and/or a gas spring.

The upward and downward motion of the seat portion 26 may be configured to assist a user with standing up from a seated position on the seat portion 26 and sitting down onto the seat portion 26 from a standing position, respectively, by applying a corresponding "assisting" force to the user. For example, the lifting mechanism 30 may be configured to bias the seat portion 26 into a raised angular positioned (see FIG. 3) from a lowered position (not shown) with respect to the base 16 and, thereby, the front cross-member 22 of the walker 10. In this way, as a user sits on the seat portion 26, the lifting mechanism 30 may act to "help" the user to slowly lower the seat portion 26 from the raised positioned (see FIG. 3) to the lowered position (and thereby sit down) by providing a supporting force against the user. Similarly, as the user stands up from a sitting position on the seat portion 26, the lifting mechanism may "help" the user raise the seat portion 26 from the lowered positioned to the raised position (and thereby stand up) by providing the supporting force against the user. In some embodiments, the lifting mechanism 30 may be configured to lift or support about 50% to about 60% of the user's body weight when sitting on the seat portion 26.

The connector system 12 may be configured to be universal so as to allow the assist seat 14 to be used with a variety of differing walkers 10 (e.g., rollators or other types of walkers). In some embodiments, the connector system 12 of the user assist seat 10 may include at least one attachment mechanism configured with a front portion of the base 16 to removably pivotably couple the base 16 of the user assist seat 10 to a front cross-member 22 of the frame of the walker 10, as shown in FIGS. 3-6. In such an embodiment, the connector system 12 of the user assist seat 10 may include at least one attachment mechanism positioned configured with a rear portion of the base 16 to removably couple the base 16 of the user assist seat 10 to a rear cross-member 24 of the frame of the walker 10 or the front portion of the base 16 may be configured to simply rest on the rear cross-member 24 of the frame of the walker 10.

The connector system 12 may further allow the lifting seat 12 to be selectively removed from a portion of the walker 10 while another portion remains attached to the walker 10, such as being selectively removed from one of the front and rear cross-members 22, 24 while remaining removably attached to the other of the front and rear cross-members 22, 24, as shown in FIGS. 3-6. For example, the connection mechanisms of the connector system 12 may allow the assist seat 14 to pivot or rotate away from a portion of the frame of the walker 10, such as from one of the front and rear cross-members 22, 24, as shown in FIGS. 3-6. In this way, the assist seat 14 may be repositionable between an activated position (see FIG. 3) and a storage position (see FIG. 6) with the assist seat 14 removed from a portion of the walker 10 (but still removably coupled to another portion). In the storage position, the frame of the walker 10 may be able to be folded or otherwise collapsed.

Figure 7:
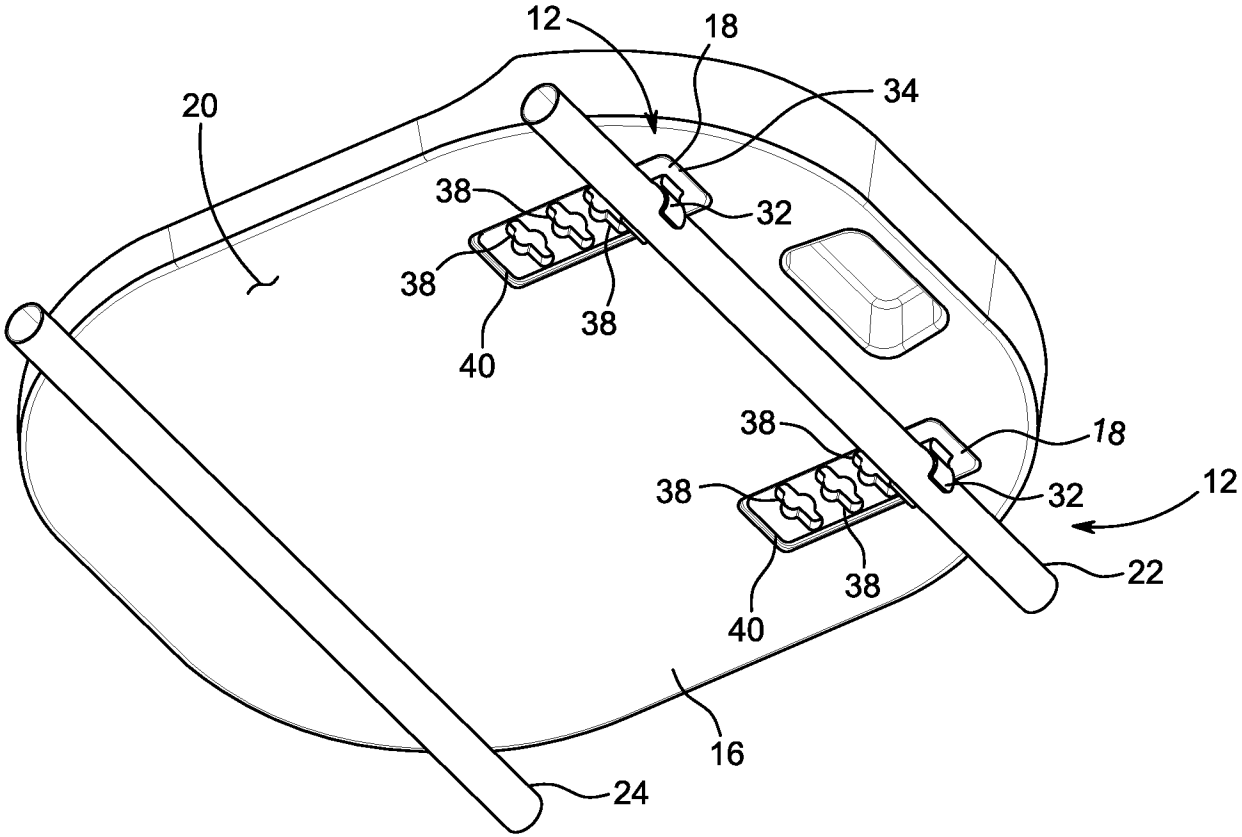
FIG. 7 is a bottom perspective view of an exemplary user assist seat and walker connection system in an engaged state with cross members of an exemplary walker.
Figure 8:
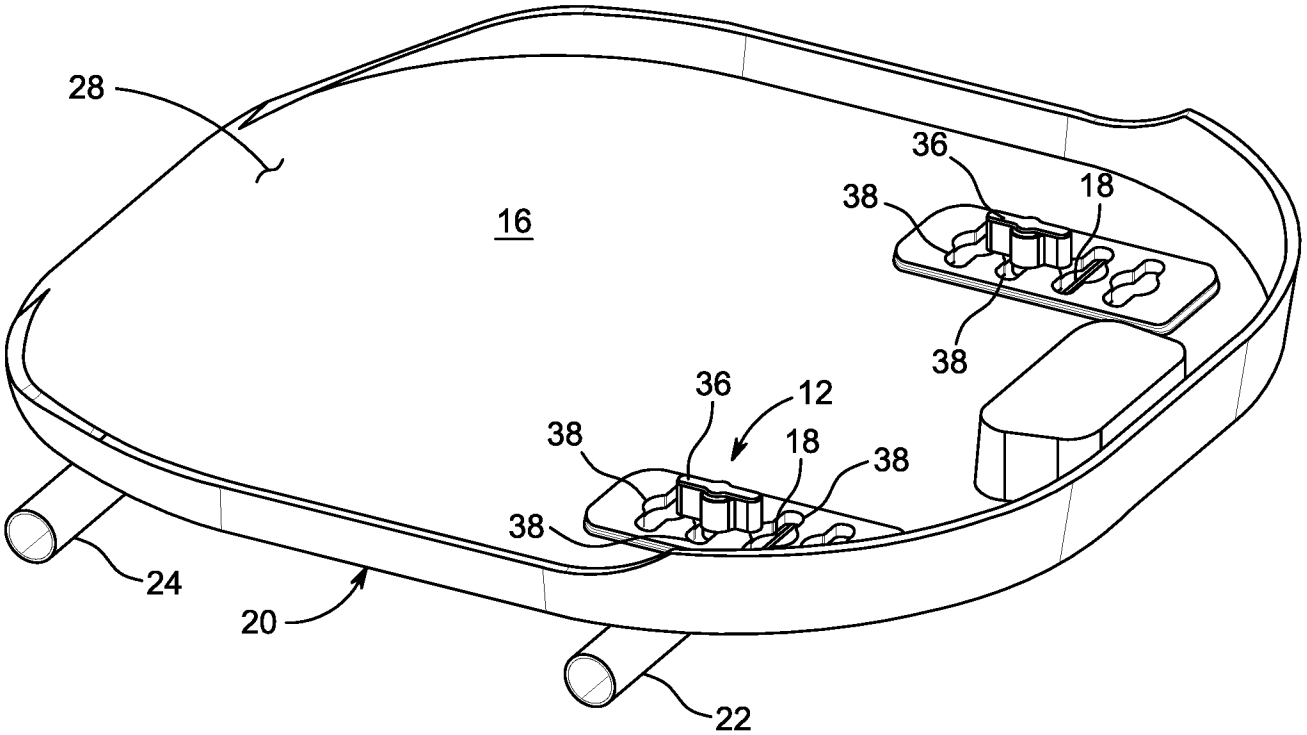
FIG. 8 is a top perspective view of the user assist seat and walker connection system of FIG. 7 in an engaged state with cross members of an another exemplary walker.
Figure 9:
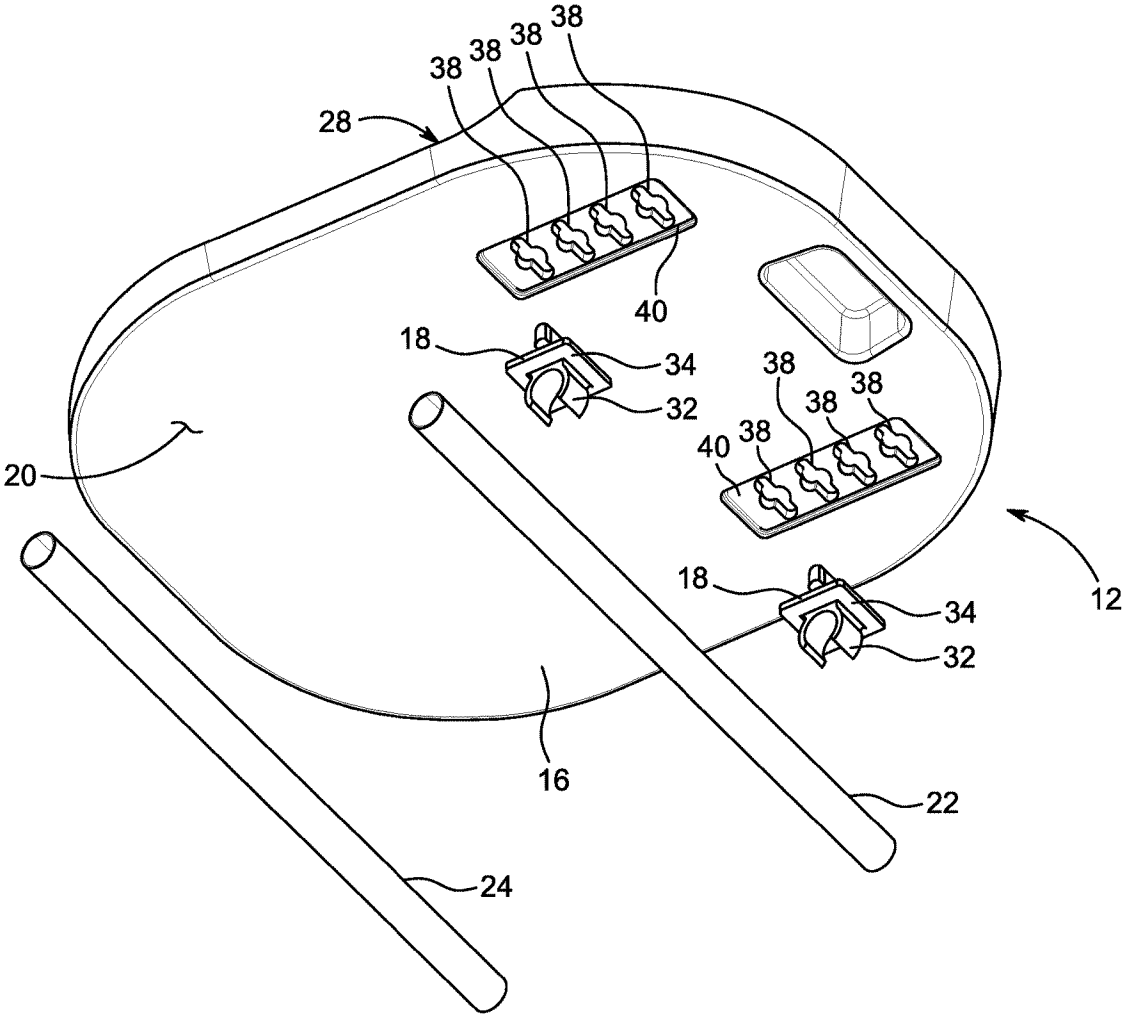
FIG. 9 is a bottom exploded perspective view of the user assist seat and walker connection system of FIG. 7.
Figure 10:
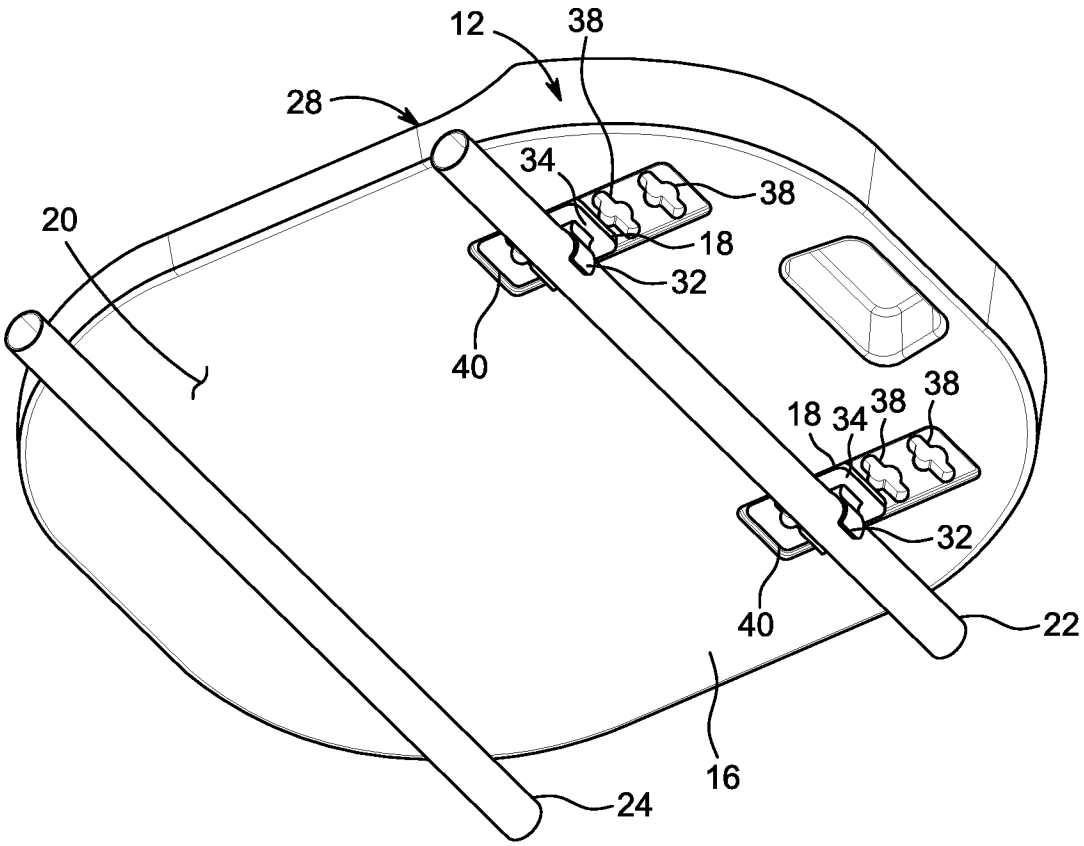
FIG. 10 is a bottom perspective view of the user assist seat and walker connection system of FIG. 7 in an engaged state with the cross members of the exemplary walker of FIG. 8.

As shown in FIGS. 7-11, in some embodiments the connection system 12 may include at least one attachment mechanism 18 that includes a clip, clamp, fastener, or any other suitable portions or mechanisms. The attachment mechanism 18 may be configured to removably secure the base 16 of the user assist seat 14 to the walker 10 (e.g., a rollator type walker), as shown in FIGS. 7, 9 and 10. The attachment mechanisms 18 may be configured to removably pivotably couple the base 16 of the user assist seat 14 to the front cross member 22 and/or the rear cross-member 24 of the walker 10. For example, as shown in FIGS. 7-11, the at least one attachment mechanism 18 may include flexible portions or fingers 32 extending from an opening to a base portion 34, as shown in FIGS. 7, 9 and 10. In some embodiments, the flexible portions 32 may be arcuate as they extend from the opening to the base portion 34. In this way, the flexible portions 32 of the attachment mechanisms 18 may form a clip portion that defines a "C" shape.

As noted above, the attachment mechanisms 18 may be configured to removably pivotably couple the base 16 of the user assist seat 14 to at least one of the front cross member 22 and the rear cross-member 24 of the walker 10. For example, as shown in FIGS. 7-11 the attachment mechanisms 18 may couple to only the front cross member 22, and the bottom portion 20 of the base 16 may rest on the rear cross-member 24. As such, the attachment mechanisms 18 may be configured to removably pivotably couple to the front cross member 22, as shown in FIGS. 7-11. The front cross member 22 of the walker 10 may be any size and shape, and the flexible portions 32 of the attachment mechanisms 18 may correspondingly be sized, shaped and/or otherwise configured to removably pivotably couple thereto. For example, as shown in FIGS. 7, 9 and 10, the front cross member 22 of the walker 10 may be substantially cylindrical with a diameter from about ½ inch to about 1 inch, such as about ¾ of an inches. In other embodiments, the front cross member 22 and/or the rear cross member 24 may be oval or another non-circular shape. The flexible portions 32 of the attachment mechanisms 18 may thereby be defined by an inner radius and sized and/or otherwise configured such that the flexible portions 32 can be manually forced (e.g., biased, elastically deformed, flexed, etc.) over the front cross member 22 via the opening such that the flexible portions 32 extend partially about the front cross member 22, as shown in FIGS. 7, 9 and 10. The flexible portions 32 may extend over a majority (or across a diameter) of the front cross member 22 such that the flexible portions 32 would have to elastically deform to allow the front cross member 22 to be removed from the opening therebetween. The attachment mechanisms 18 may thereby be removably pivotably or rotatably coupled to front cross member 22. In some embodiments, the seat 14 may also be provided or configured to removably pivotably couple to the rear cross-member 24.

As shown in FIGS. 8 and 10, the attachment mechanisms 18 may include an irregular or non-circular shaped nut 36 that is rotatably coupled to the base portion 34. The irregular shaped nut 36 may be elongate such that it defines a longer length that width, for example. The irregular shaped nut 36 may include or define any non-circular shape. In some embodiments, the nut 36 may be symmetrical about two planes, such as planes along the length and width directions. The nut 36 may be rotatably coupled to the base portion 34 via any mechanism. For example, the nut 36 may be rotatably coupled to the base portion 34 via a post that extends from the base portion 34 and into the nut 36.

The base 16 may include at least one irregular or non-circular shaped aperture 38 extending therethrough from the inner portion 28 to the outer portion 20, as shown in FIGS. 7-11. The at least one irregular shaped aperture 38 may be positioned proximate to the front portion of the seat 14 for removably pivotably coupling the front portion of the seat 14 to the front cross member 22 via the at least one attachment mechanism 18. Similarly, the base 16 may also include at least one irregular shaped aperture 38 positioned proximate to the rear portion of the seat 14 (not shown) for removably pivotably coupling to the rear cross member 24. As shown in FIGS. 7-11, the base 16 may include a plurality of the irregular shaped apertures 38 spaced along a direction extending between the front and rear portions of the base 16 seat 14 along both the left and right hands sides of the seat 14. The plurality of the irregular shaped apertures 38 spaced along the base 16 in a direction extending between the front and rear portions or ends thereof may allow for the seat 14 to be removably pivotably coupled to a variety of differing walkers 10 that include differently configured frames, such as different spacings between the front cross member 22 and the rear cross-member 24.

As explained further below, one of the plurality of the irregular shaped apertures 38 may be utilized via an attachment mechanism 18 to removably pivotably couple the seat 14 to the front cross member 22 of a walker 10. In such an arrangement, a rear portion of the underside or bottom portion 20 of the base 16 of the seat 14 may rest on the rear cross-member 24. Different rollators may include different spacing between the front cross member 22 and the rear cross-member 24, such as between about 7 inches and about 11 inches. The plurality of the irregular shaped apertures 38 may thereby allow the front portion of the base 16 of the seat 14 to be removably pivotably coupled to a front cross member 22 of a particular walker 10 via at least one of the apertures 38 and a corresponding attachment mechanism 18 in a relative position to ensure that the rear portion of the base 16 rests on the rear cross-member 24 of the walker 10, as shown in FIGS. 7 and 10. The plurality of positions of the seat 14 relative to the front cross member 22 afforded by the plurality of spaced irregular shaped aperture 38 may also allow the front portion of the seat 14 to be coupled in a relative positioned to a particular walker 10 such that the seat 14 fits between the left and right leg portions of the walker 10, and/or prevents the seat 14 from interfering with the pivoting of the seat 14 about the front cross member 22 to allow for folding or collapsing of the walker 10.

Figure 11:
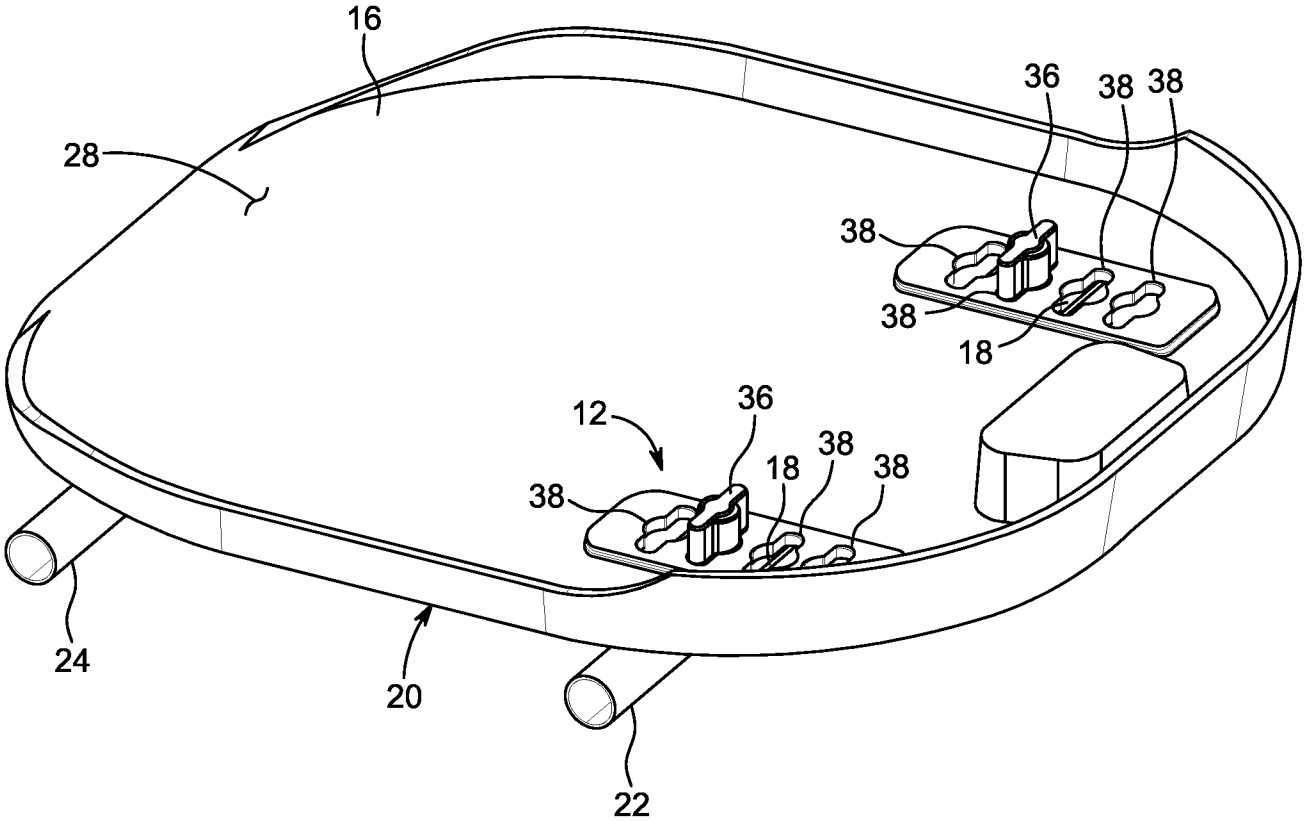
FIG. 11 is a top perspective view of the user assist seat and walker connection system of FIG. 10 in a disengaged state.

The irregular shaped apertures 38 may correspond in size, shape and configuration to the irregular shaped nut 36 of an attachment mechanism 18, as shown in FIGS. 7-11. As also shown in FIGS. 7-11, the size, shape and configuration of the base portions 34 of the attachment mechanism 18 and the irregular shaped apertures 38 of the seat 14 may differ such that the base portion 34 of the attachment mechanism 18 is prevented from passing through the irregular shaped apertures 38. In this way, the attachment mechanisms 18 may be removably coupled to the base 16 via any of the at least one irregular shaped apertures 38, as shown in FIGS. 7-11. For example, as shown in FIGS. 10 and 11, the base portion 34 of an attachment mechanism 18 may be positioned adjacent or in abutment with a bottom surface 16 of the base 16 about an aperture 38 such that the nut 36 is aligned with the aperture 38 and the attachment mechanism 18 extends through the aperture 38 with the nut 36 positioned adjacent the upper or top surface 28 of the base 16 about the aperture 38. In such an arrangement, the irregular shaped nut 36 may be manually rotated with respect to the corresponding irregular shaped aperture 38 such the irregular shapes of the aperture 38 and the nut 36 are no longer aligned, as shown in FIG. 8. In some embodiments, the base portion 34 of the attachment mechanisms 18 may be positioned within a slot or recess 40 formed into the underside of the base 16 of the seat 14. The slot 40 and the base portion 34 of the attachment mechanisms 18 may be configured such that at least the base portion 34 and the flexible portions 32 extending therefrom are prevented from rotating relative to the base 16 when the base portion 34 is positioned within the slot 40. In this way, the nut 36 may be manually rotated with respect to the base portion 34 and the flexible portions 32 extending therefrom, as well as the corresponding irregular shaped aperture 38, to removably lock the attachment mechanism 18 to the seat 14, and thereby removably pivotably couple the respective portion of the seat 14 and the engaged front 22 or rear 24 cross member.

In such an arrangement with the irregular shapes of the aperture 38 and the nut 36 offset or askew (i.e., not aligned), as shown in FIG. 8, the base 16 of the seat 14 may be removably trapped between the nut 36 and the base portion 34 to removably couple or affix the attachment mechanism 18 to the seat 14. To remove the attachment mechanism 18 from the base 16 of the seat 14 in such an arrangement, the nut 36 may be manually engaged and rotated with respect to and the corresponding irregular shaped aperture 38 (and potentially the base portion 34 thereof) such the irregular shapes of the aperture 38 and the nut 36 are aligned, as shown in FIG. 11. In such an arrangement (i.e., the irregular shapes of the aperture 38 and the nut 36 aligned), the nut 36 may be passed through the aperture 38 to remove the attachment mechanism 18 from the base 16 of the seat 14, as shown in FIG. 9. The removed attachment mechanism 18 may remain removably coupled to the front 22 or rear 24 cross member.

With the attachment mechanisms 18 removed from the lifting or assist seat 14, the seat 12 may be utilized on existing desired seating substrate, such as any desired seating space, device, mechanism, member, platform or area. A desired seating substrate may be any substrate onto which a user wants to sit on with the use of the assist seat 14. A desired seating substrate may be purposefully designed for seating (e.g., a chair, seat, couch, bench, etc.) or not purposefully designed for seating (e.g., the ground, a ledge, a step, etc.). With the seat 14 removed from the at least one attachment mechanism 18 (and either remaining coupled to the walker 10 or also removed from the walker 10), the underside or bottom portion 20 of the base 16 of the assist seat 14 may be manually positioned on a desired seating substrate by the user. It is noted that the bottom portion 20 of the base 16 of the assist seat 14 may be configured as substantially flat or planar, particularly about the at least one irregular aperture 38, so that the connection system 12 does not interfere with use of the assist 14 both on the walker 10 (via the at least one attachment mechanism 18) and a desired seating substrate (when the at least one attachment mechanism 18 is removed from the seat 14).

As opposed to removing the attachment mechanism(s) 18 from the seat 14 so that the bottom side 20 of the base 16 may be manually positioned on a desired seating substrate without the attachment mechanism(s) 18 interfering, in some embodiments the attachment mechanism(s) 18 may be repositionable between an active position or arrangement in which they are able to be removably coupled with the front 22 or rear 24 cross member and an inactive or stored position or arrangement in which they are retraced from the bottom side 20 of the base 16 so as to not extend past the bottom side 20. In the inactive or stored position the attachment mechanism(s) 18 does not interfere with use of the base 16 on a seating substrate. In some such alternative embodiments, the attachment mechanism(s) 18 may be configured to pivot or rotate into one or more corresponding cavity or recess such that the bottom side 20 of the base 16 provides a relatively flat surface 20 for unconstructive engagement onto a seating substrate.

Figure 12:
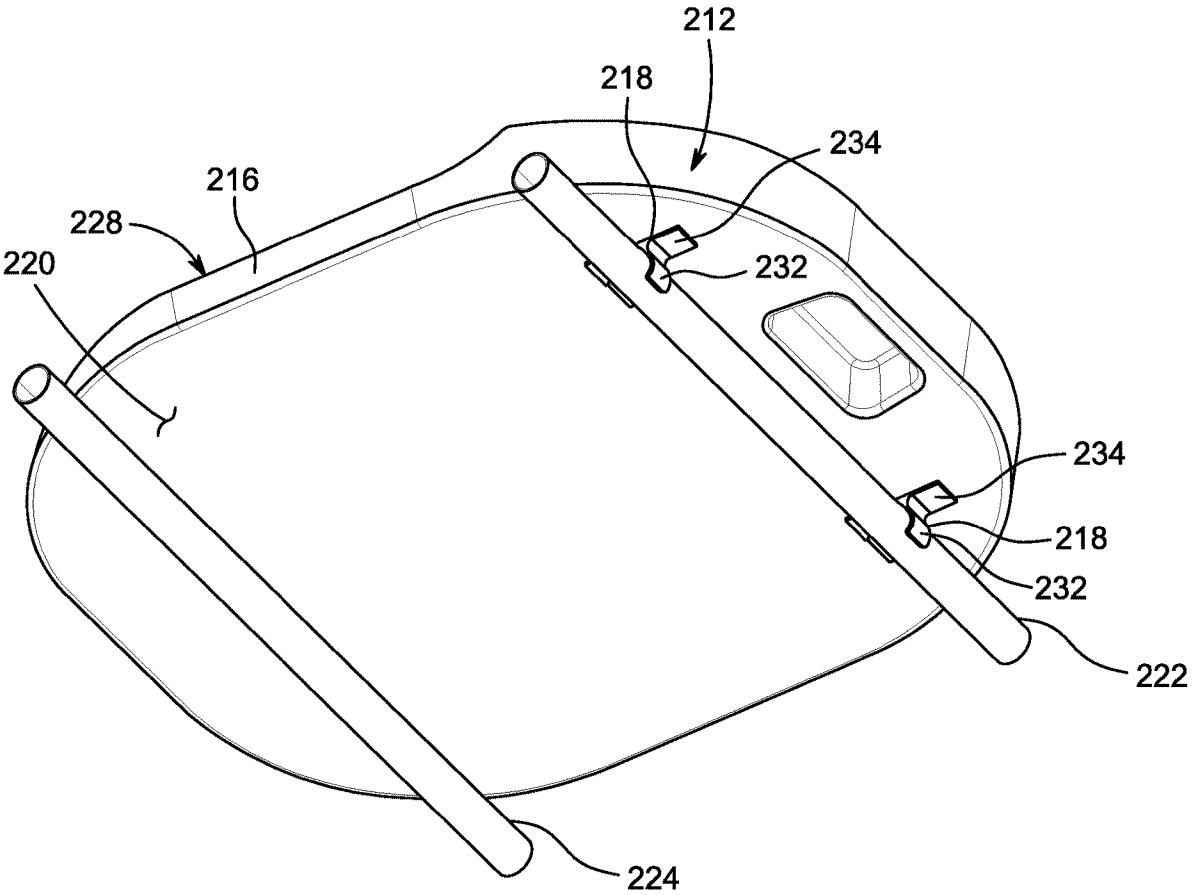
FIG. 12 is a bottom perspective view of another exemplary user assist seat and walker connection system in an engaged state with cross members of an exemplary walker.
Figure 13:
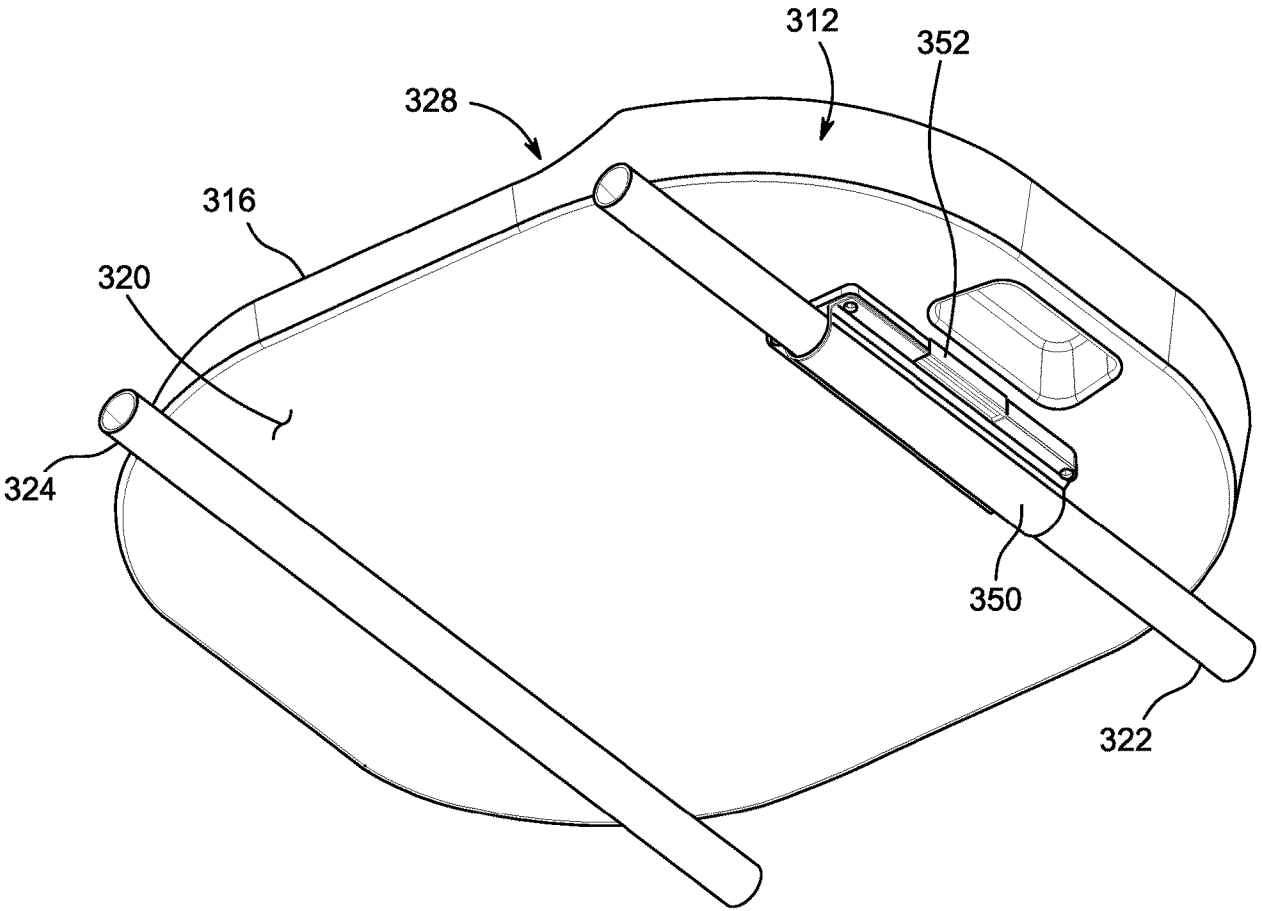
FIG. 13 is a bottom perspective view of another exemplary user assist seat and walker connection system in an engaged state with cross members of an exemplary walker.

FIG. 12 illustrates another connector system 212 according to the present disclosure. The connector system 212 of FIG. 13 is similar to the connector system 12 of FIGS. 7-11 described above, and therefore like reference numerals preceded with "2" are used to indicate like aspects, processes or functions, and the description above directed to aspects, processes or functions thereof (and the alternative embodiments thereof) equally applies to the connector system 212. As shown in FIG. 12, the connector system 212 differs from the connector system 12 in that the underside or bottom portion 220 of the base 216 of the seat 214 is substantially flat or planar. As also shown in FIG. 12, the base portions 234 of the attachment mechanisms 218 are directly fixed to the underside or bottom portion 220 of the base 216 of the seat 214. In this way, an aperture through the base 216, and the nut extending through the base 216, is not included. Further, the attachment mechanisms 218 may not be removable from the base 216.

Figure 15:
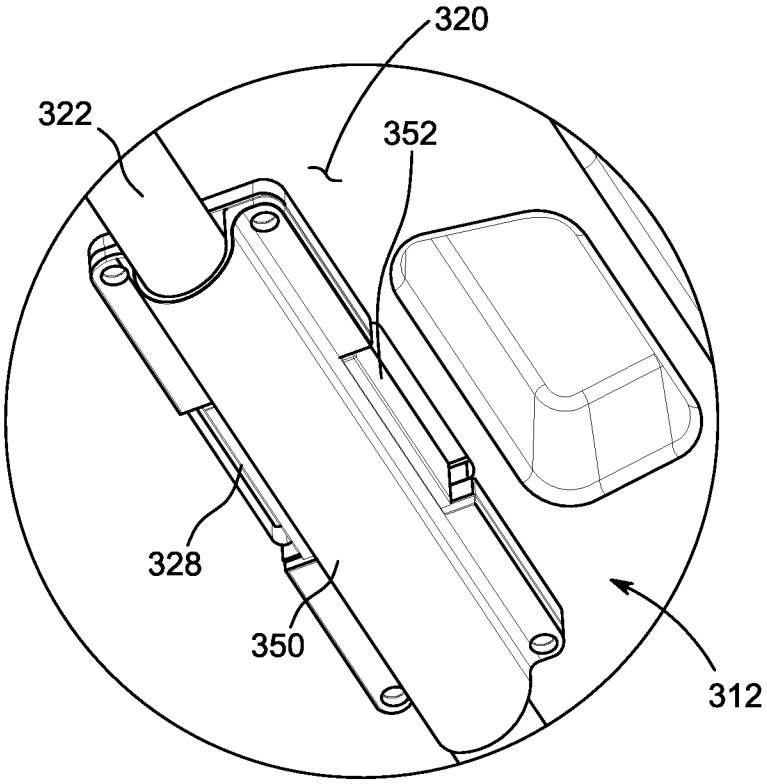
FIG. 15 is an enlarged bottom perspective view of the exemplary user assist seat and walker connection system of FIG. 13 in a disengaged state.
Figure 14:
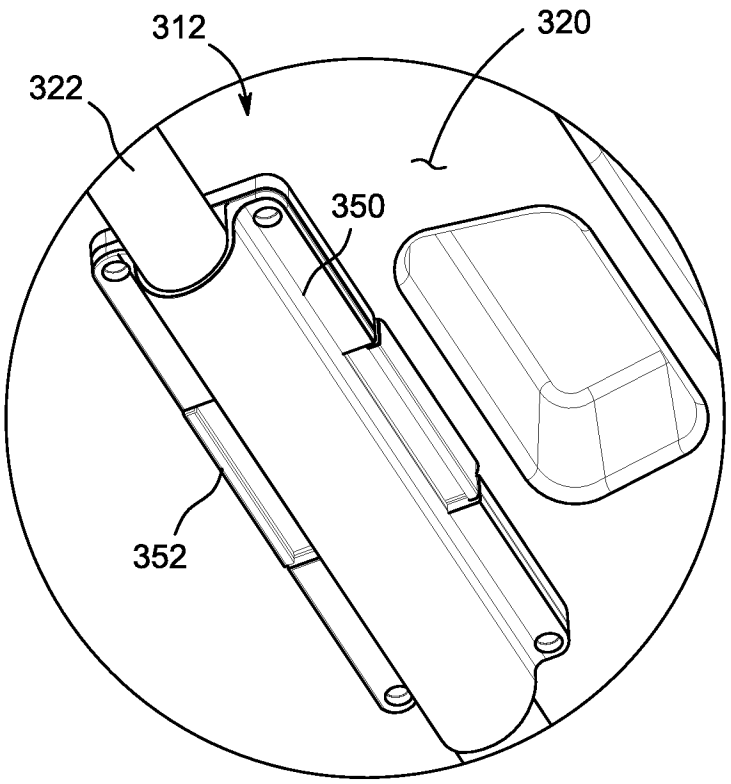
FIG. 14 is an enlarged bottom perspective view of the exemplary user assist seat and walker connection system of FIG. 13 in the engaged state.
Figure 16:
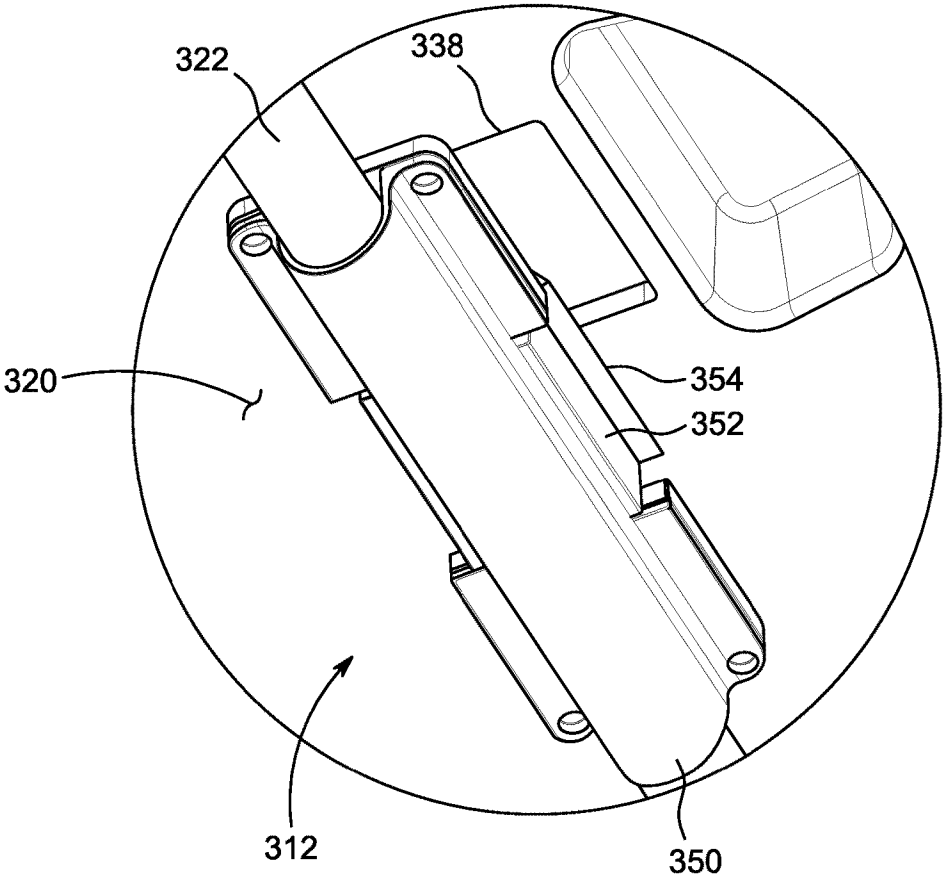
FIG. 16 is an enlarged exploded bottom perspective view of the exemplary user assist seat and walker connection system of FIG. 13.

FIGS. 13-16 illustrate another connector system 312 according to the present disclosure. The connector system 312 of FIGS. 13-16 is similar to the connector system 12 of FIGS. 7-11 and the connection system 212 of FIG. 12 described above, and therefore like reference numerals preceded with "3" are used to indicate like aspects, processes or functions, and the description above directed to aspects, processes or functions thereof (and the alternative embodiments thereof) equally applies to the connector system 312. As shown in FIGS. 13-16, the connector system 312 differs from the connector systems 12 and 212 in that the connector system 312 includes a mount 350 with manually engageable tabs or buttons 352 that is pivotably or rotatably attached to the front cross member 324 (and/or the rear cross member 324) for removably coupling to with an aperture or recess 328 in the base 316 of the seat 314. As shown in FIGS. 14 and 15, the tabs 352 may normally be biased outwardly (FIG. 14), but able to be manually deflected inwardly (FIG. 15). As shown in FIGS. 15 and 16, the tabs 352 may include a lip 354 that extends outwardly from the tabs 352 at an upper end or portion thereof. The mount 350 may be configured such that when the tabs 352 are deflected inwardly (e.g., manually by a user), the mount 350 is positionable partially within the aperture 328 in the base 316 such the lips 354 are able to pass through/into the corresponding aperture 328, as shown in FIG. 15. Once the lips 354 pass the top or upper surface 328 or feature of the aperture 328 of the base 316, they may move outwardly according to their natural bias, as shown in FIGS. 14 and 15. In such an arrangement, the base 316 of the seat 314 may be trapped between the lips 354 and the mount 350 and/or the front cross member 324 to removably pivotably couple the assist seat thereto. Manuel engagement and biasing of the tabs 352 of the mount 350 inwardly thereby inwardly biases or translates the lips 354 inwardly and allows the mount 350 to pass through the aperture 328 so the seat can be removed from the mount 350 (which is coupled to the front cross member 324).

Figure 17:
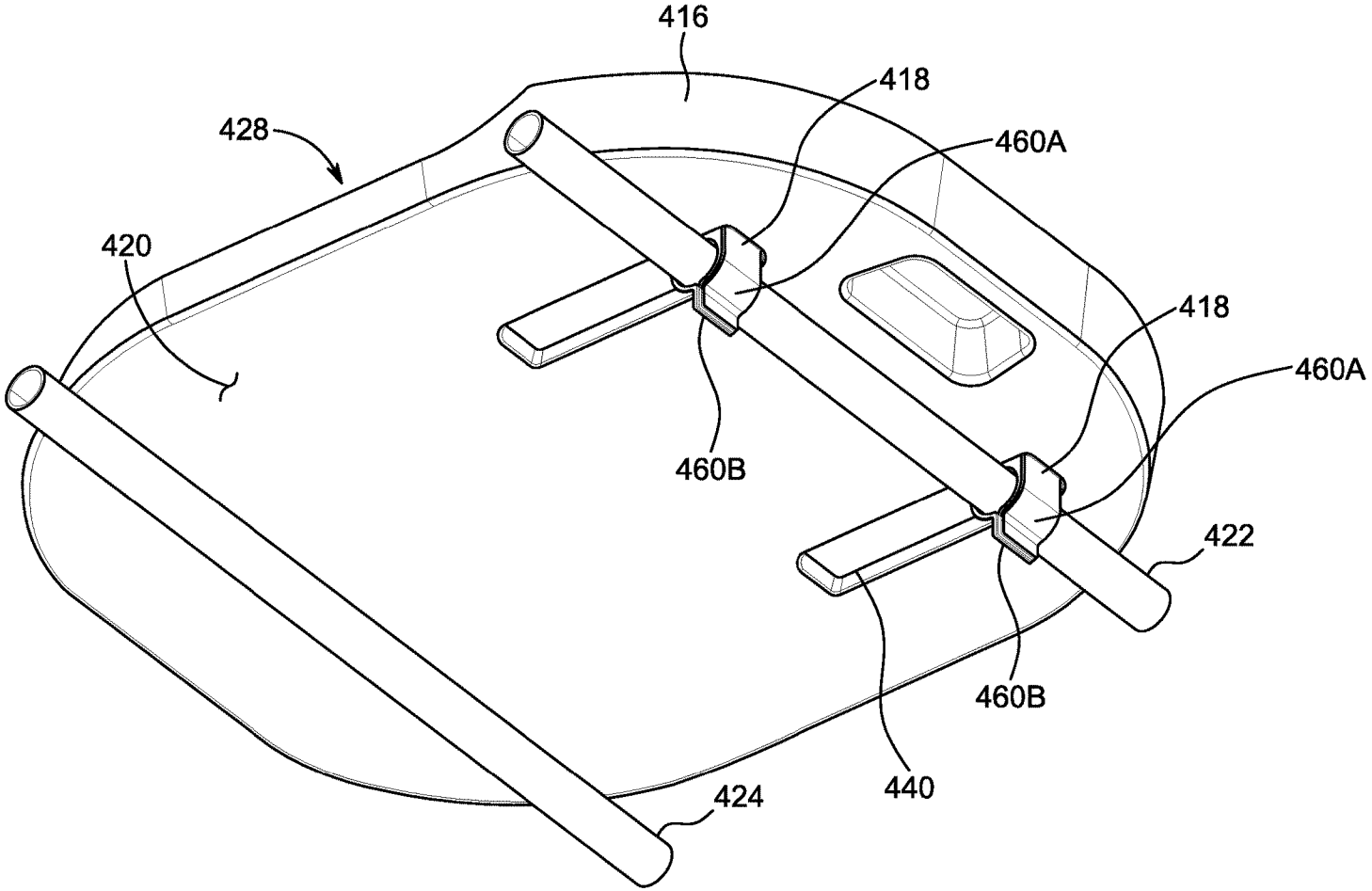
FIG. 17 is a bottom perspective view of another exemplary user assist seat and walker connection system in an engaged state with cross members of an exemplary walker.
Figure 18:
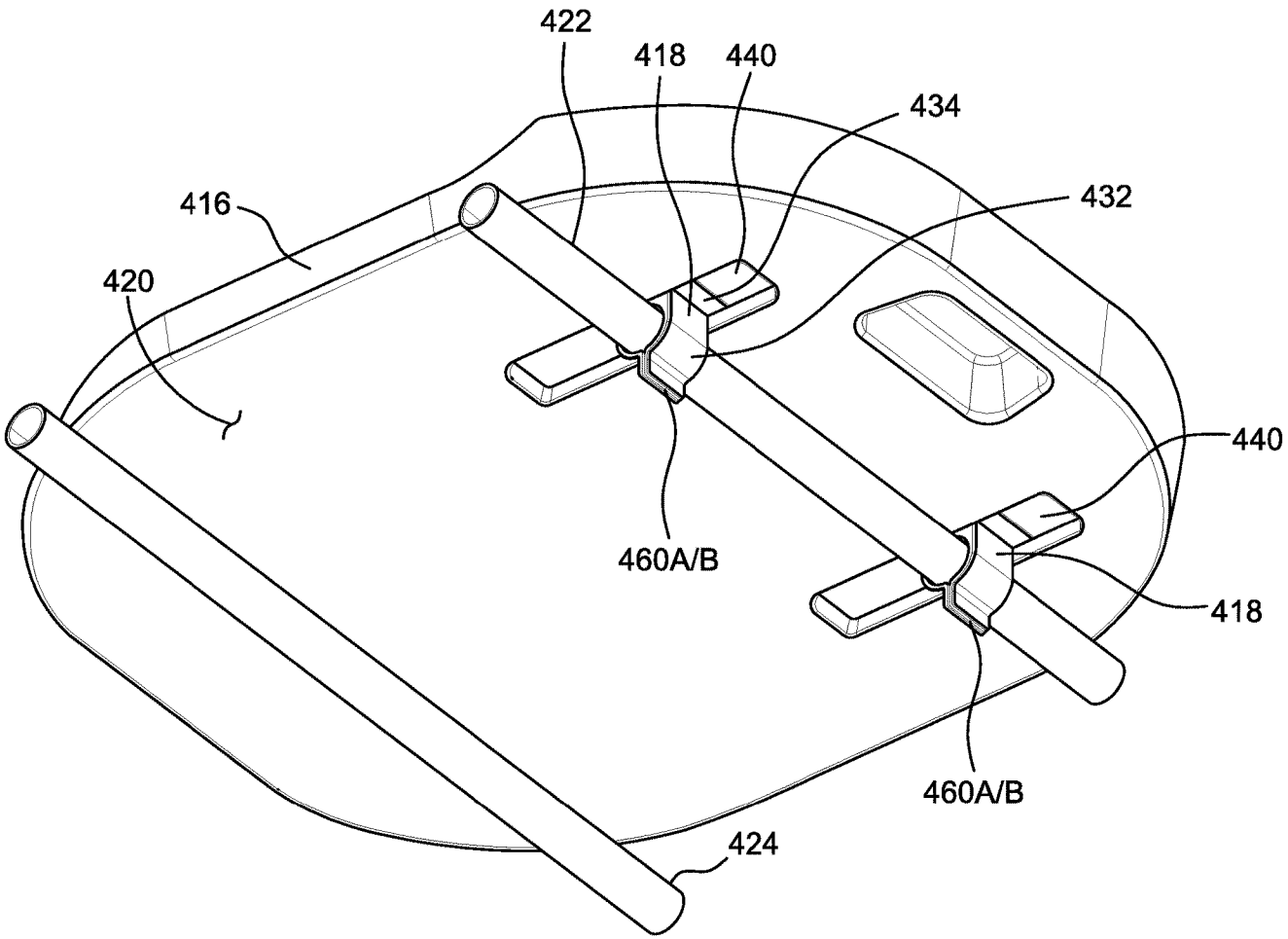
FIG. 18 is a bottom perspective view of the exemplary user assist seat and walker connection system of FIG. 17 in an engaged state with cross members of another exemplary walker.
Figure 19:
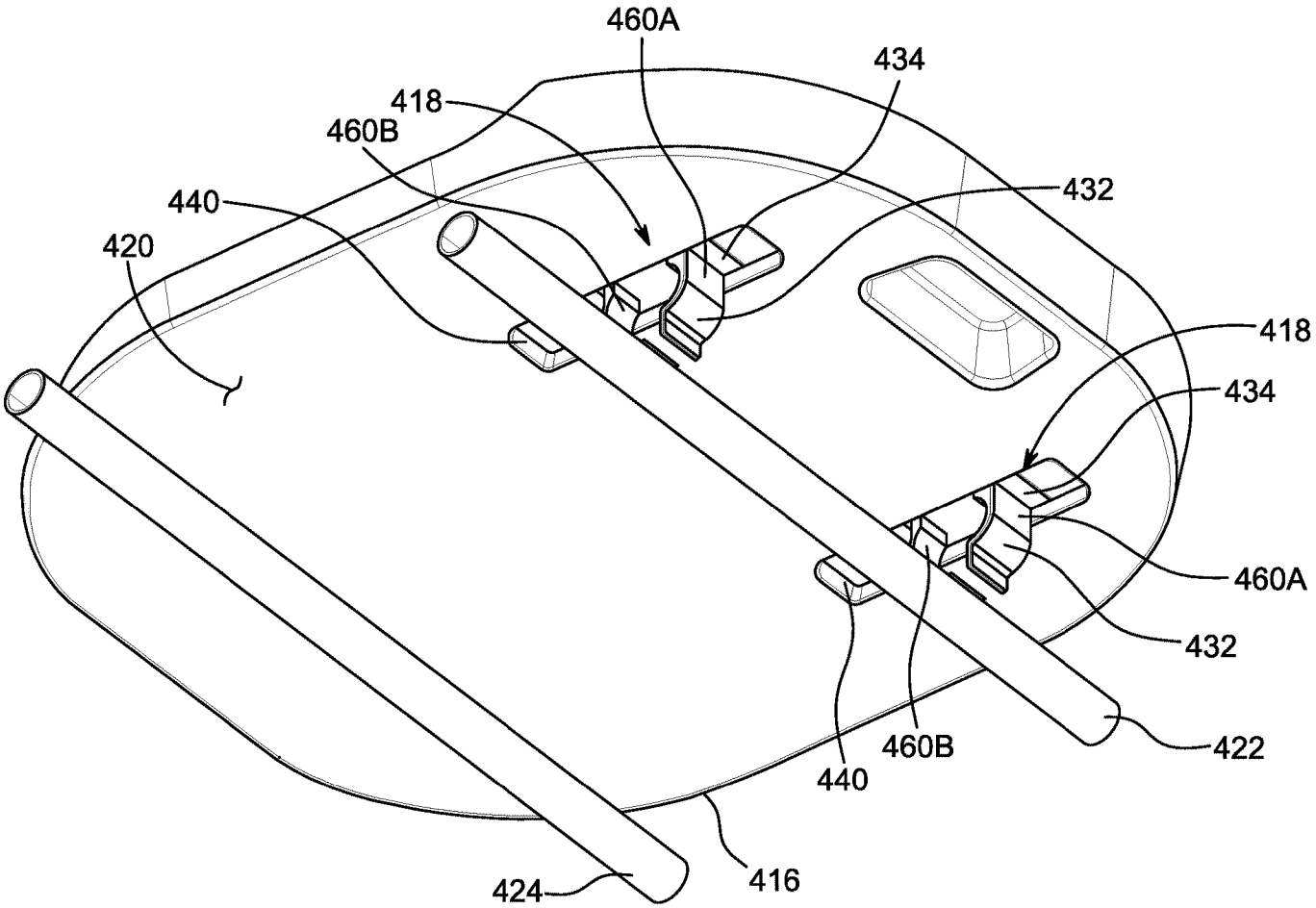
FIG. 19 is a bottom perspective view of the exemplary user assist seat and walker connection system of FIG. 17 in a disengaged state.

FIGS. 17-19 illustrate another connector system 412 according to the present disclosure. The connector system 412 of FIGS. 17-19 is similar to the connector system 12 of FIGS. 7-11, the connection system 212 of FIG. 12 and the connector system 312 of FIGS. 13-16 described above, and therefore like reference numerals preceded with "4" are used to indicate like aspects, processes or functions, and the description above directed to aspects, processes or functions thereof (and the alternative embodiments thereof) equally applies to the connector system 412. As shown in FIG. 17-19, the connector system 412 differs from the connector systems 12, 212 and 312 in that the attachment mechanisms 418 are formed of mating clip portions 460A and 460B that slid along a slot 440. The mating clip portions 460A and 460B each thereby form part of the base portion 434 and one of the arcuate portions 432. The mating clip portions 460A and 460B may be normally biased along the slot 440 into a closed or abutting relationship to removably engage a particular front cross member 422 (or the rear cross member 424) as shown in FIGS. 17 and 18. In some other embodiments, the mating clip portions 460A and 460B may be independently fixable along the slot 440 via a fixing mechanism positioned on the top side or portion 428 of the base 416, for example. In another example, the mating clip portions 460A and 460B may frictionally slide along the slot 440 such that the mating clip portions 460A and 460B are able translate along the slot 440 only when a relatively high amount of force is used. The friction within the slot 440 thereby maintains the position mating clip portions 460A and 460B when not subjected to such forces by a user, and allows the mating clip portions 460A and 460B to engage the front cross member 422 (or the rear cross member 424) to removably pivotably couple the seat thereto.

Figure 20:
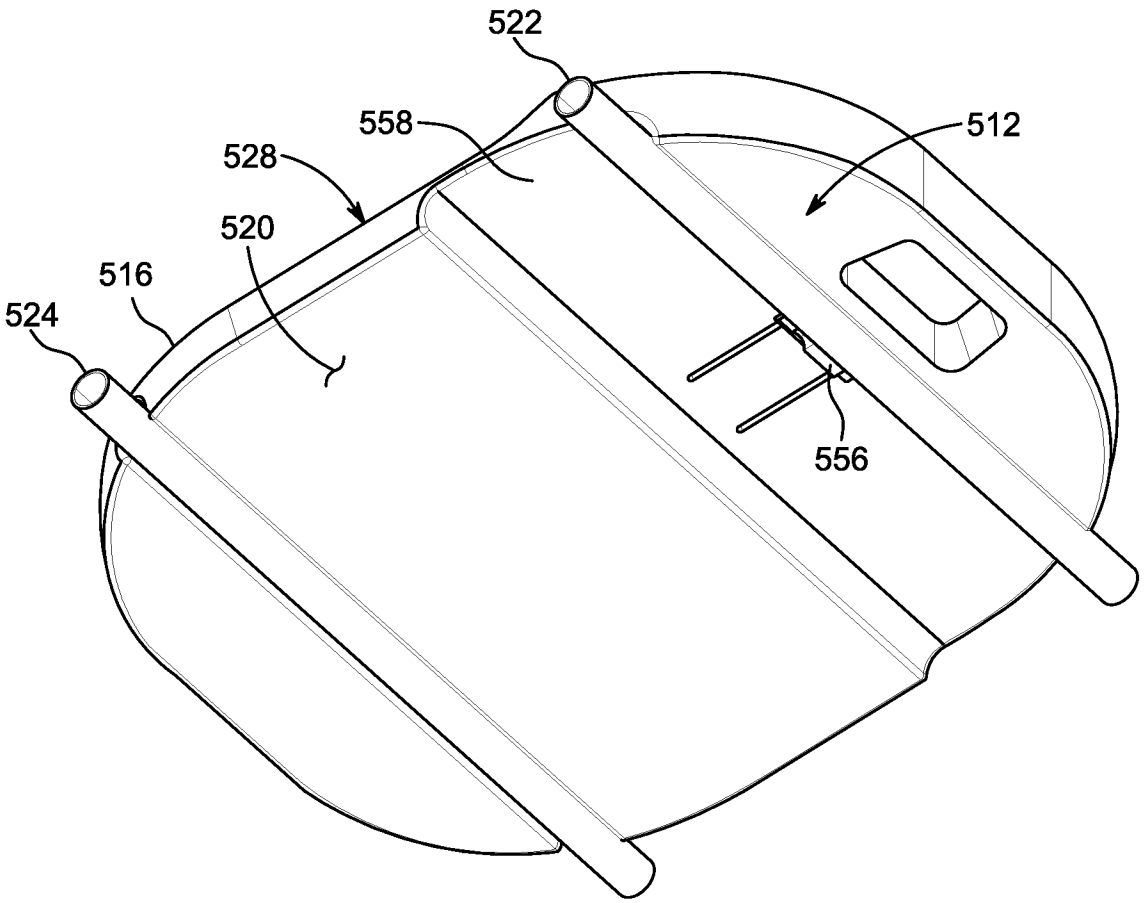
FIG. 20 is a bottom perspective view of another exemplary user assist seat and walker connection system in an engaged state with cross members of an exemplary walker.
Figure 21:
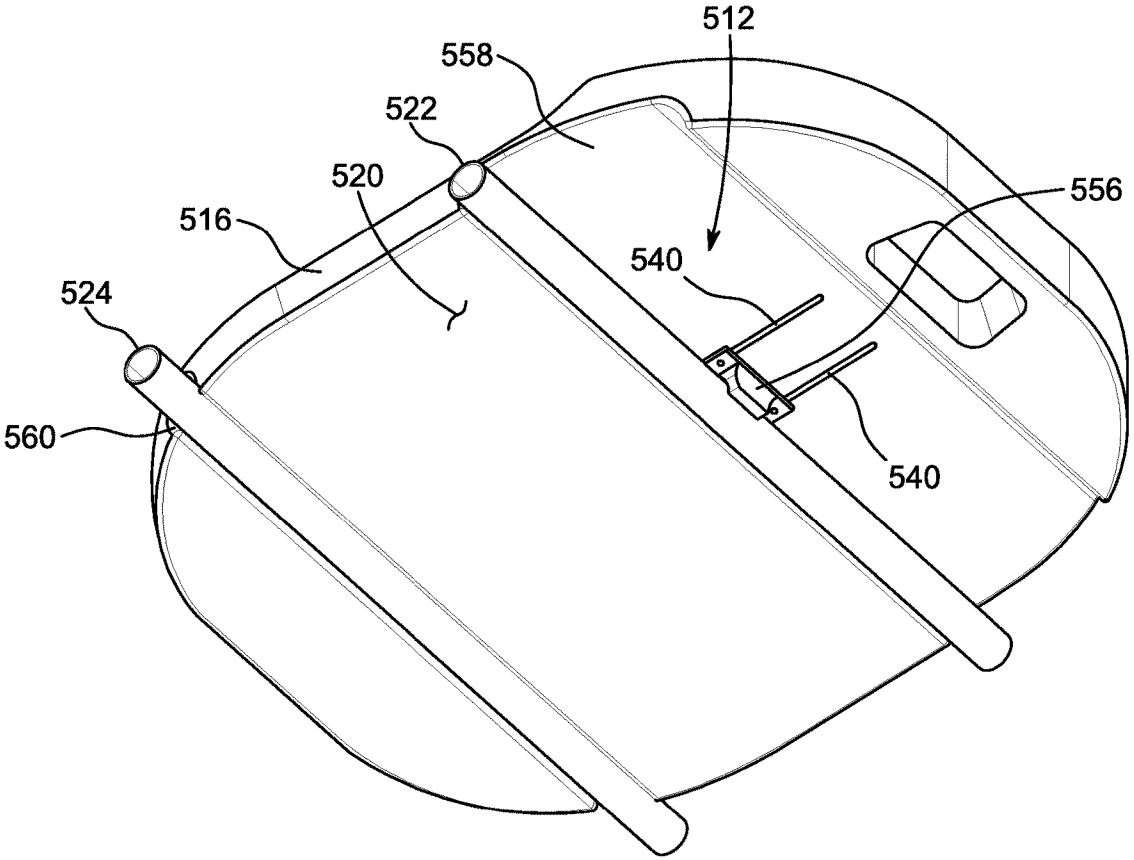
FIG. 21 is a bottom perspective view of the exemplary user assist seat and walker connection system of FIG. 20 in an engaged state with cross members of another exemplary walker.
Figure 22:
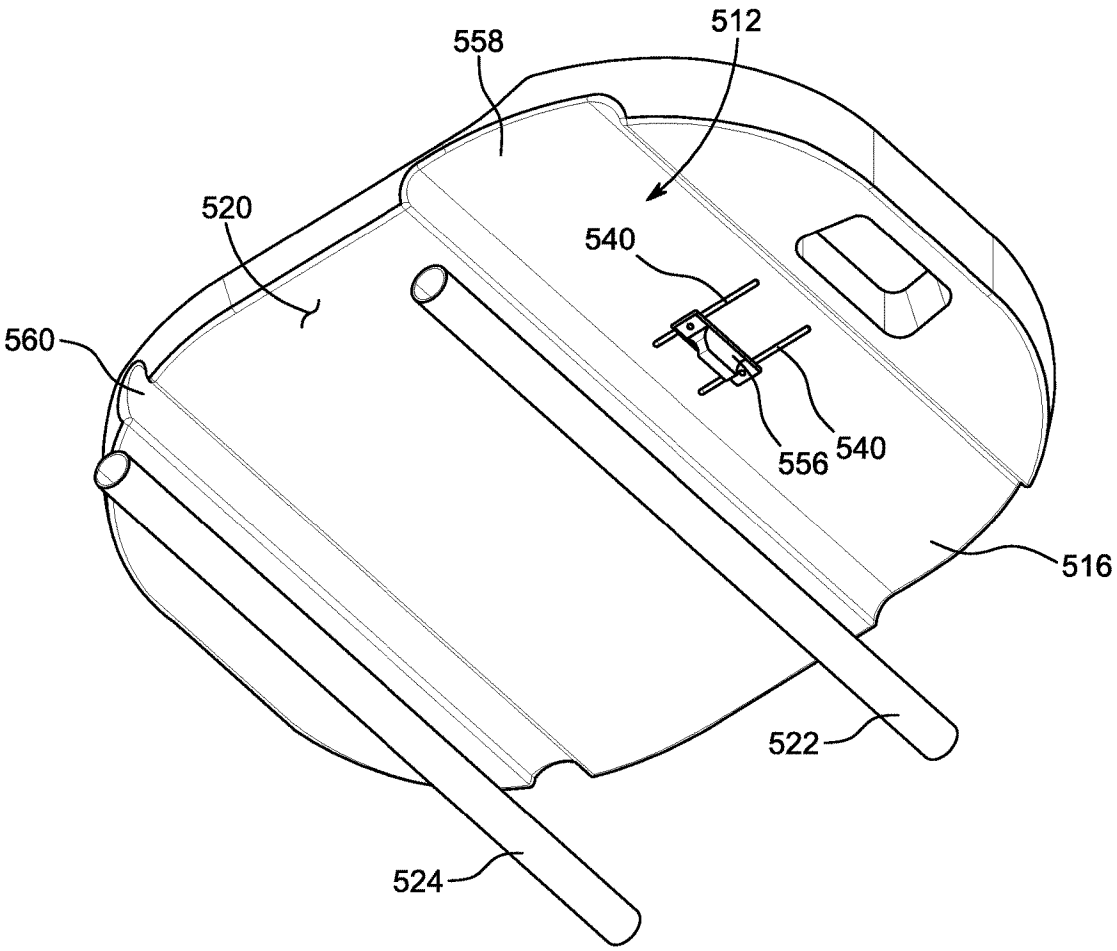
FIG. 22 is a bottom perspective view of the exemplary user assist seat and walker connection system of FIG. 20 in a disengaged state.

FIGS. 20-22 illustrate another connector system 512 according to the present disclosure. The connector system 512 of FIGS. 20-22 is similar to the connector system 12 of FIGS. 7-11, the connection system 212 of FIG. 12, the connector system 312 of FIGS. 13-16 and the connector system 412 of FIGS. 17-19 described above, and therefore like reference numerals preceded with "5" are used to indicate like aspects, processes or functions, and the description above directed to aspects, processes or functions thereof (and the alternative embodiments thereof) equally applies to the connector system 512. As shown in FIGS. 20-22, the connector system 512 differs from the connector systems 12, 212, 312 and 412 in that the attachment mechanisms 518 is a double-sided slidable engagement member 556 that engages along one side of the front cross member 522 (or rear cross member 524). As shown in FIGS. 20-22, the base 516 also differs from previously discussed embodiments in that a front recess 558 and a rear recess 560 is formed into the underside 520 of the base 516 for the front and rear cross members 522, 524, respectively. The rear recess 560 may be configured to secure the rear cross member 524 to the base 516 such that movement of the base 516 along a direction extending between the front and rear cross members 522, 524 is prevented.

As shown in FIGS. 20 and 21, the front recess 558 may be configured to allow numerous different positions of the base 516 on the front cross member 522 along a direction extending between the front and rear cross members 522, 524 when the rear cross member 524 is positioned within the rear recess or slot 560. The double-sided slidable engagement member 556 may be slidable within at least one slot 540 extended along the direction extending between the front and rear cross members 522, 524 to trap the front cross member 522 between either a front or rear end or edge of the front recess 558 and an engagement surface of the respective side of the member 556, as shown in FIGS. 21 and 22. The engagement surfaces may be configured to mate with the front cross member 522, such as extend partially thereabout to prevent liftoff of the seat therefrom. In other embodiments, however, the engagement surface of the respective side of the member 556 may engage the front cross member 522 and be sized, shaped and/or otherwise configured to removably couple the base 516 to the front cross member 522 without the front cross member 522 abutting the front or rear end or edge of the front recess 558.

Figure 25:
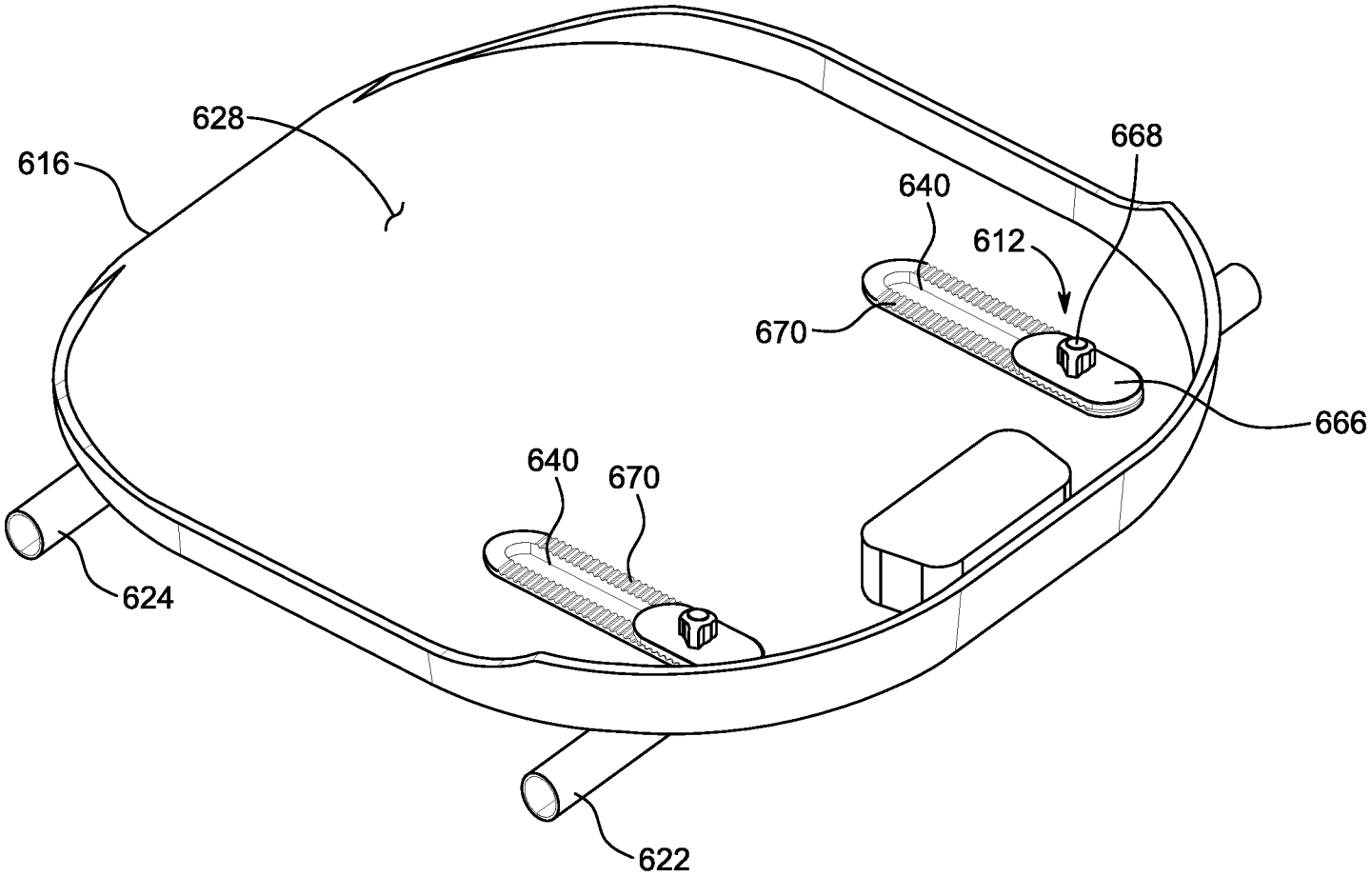
FIG. 25 is a top perspective view of the user assist seat and walker connection system of FIG. 23 in the engaged state.
Figure 26:
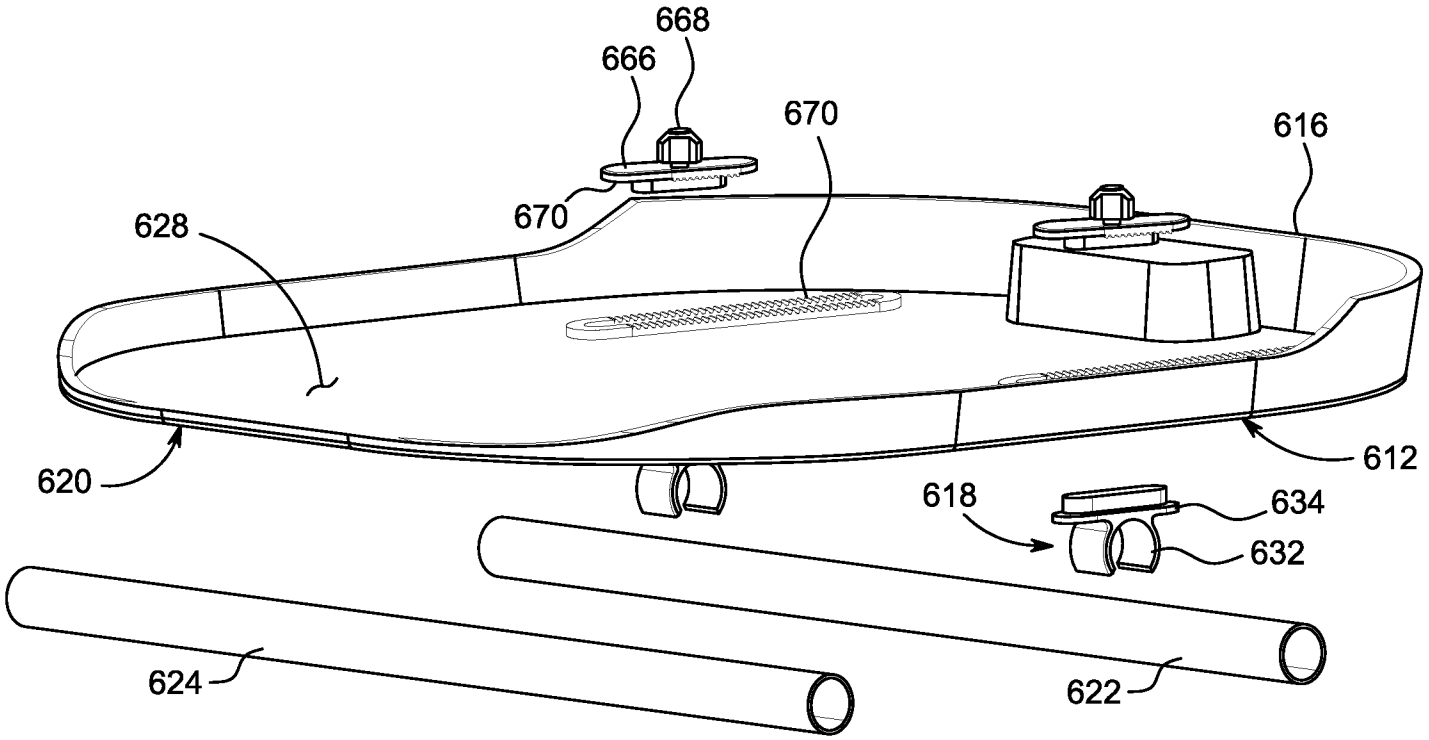
FIG. 26 is an exploded perspective view of the exemplary user assist seat and walker connection system of FIG. 23.
Figure 27:
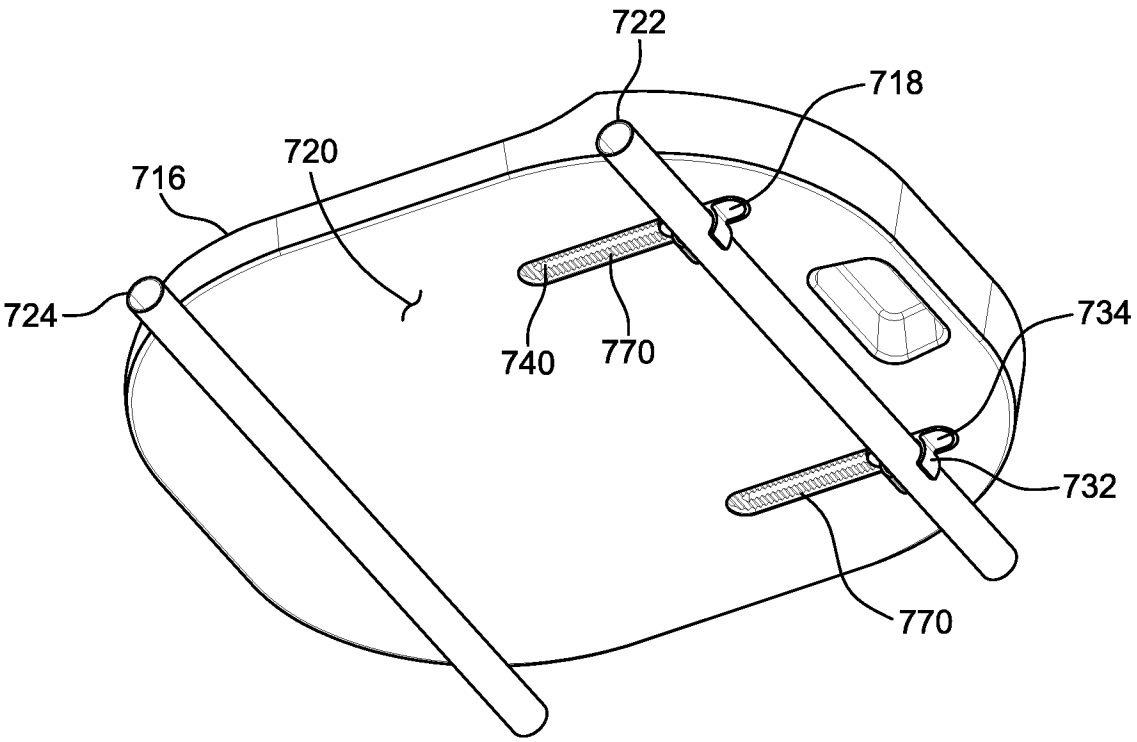
FIG. 27 is a bottom perspective view of another exemplary user assist seat and walker connection system in an engaged state with cross members of an exemplary walker.
Figure 28:
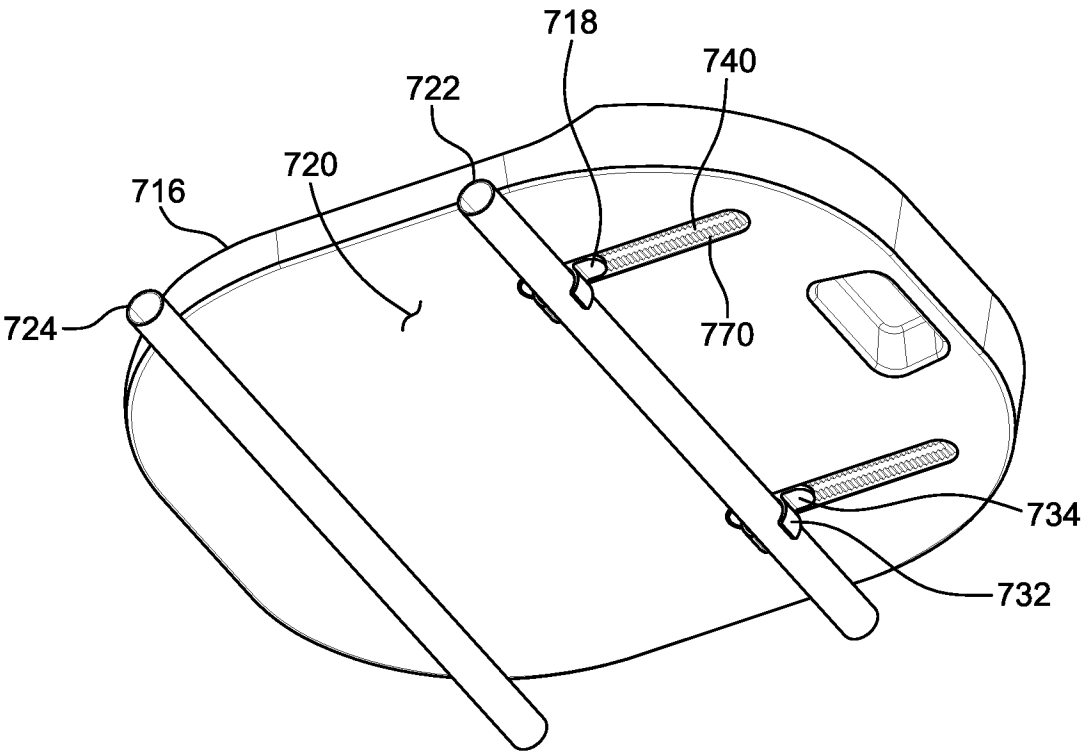
FIG. 28 is a bottom perspective view of the exemplary user assist seat and walker connection system of FIG. 27 in an engaged state with cross members of another exemplary walker.

FIGS. 23-26 illustrate another connector system 612 according to the present disclosure. The connector system 612 of FIGS. 25-27 is similar to the connector system 512 of FIGS. 20-22 is similar to the connector system 12 of FIGS. 7-11, the connection system 212 of FIG. 12, the connector system 312 of FIGS. 13-16, the connector system 412 of FIGS. 17-19 and the connector system 512 of FIGS. 20-22 described above, and therefore like reference numerals preceded with "6" are used to indicate like aspects, processes or functions, and the description above directed to aspects, processes or functions thereof (and the alternative embodiments thereof) equally applies to the connector system 612. As shown in FIGS. 23-26, the connector system 612 differs from the connector systems 12, 212, 312, 412 and 512 in that the base portion 634 of the attachment mechanism(s) 618 is provided within a slot 640 formed into the bottom or underside 620 of the base 614, and the top or upper side of the base 614 includes a surface texture 670 about the slot 640.

As shown in FIGS. 25 and 26, the top portion or side 628 of the base 616 may include surface texture or ridges 670 extending about and/or adjacent to each slot 640. As also shown in FIGS. 25 and 26, the attachment mechanisms 518 may include a cap 666 and a nut or screw 668. The cap 666 may include surface texture or ridges 670 on a lower side thereof for mating with the surface texture 670 adjacent to the corresponding slot 640 to assist in preventing movement or translation of the attachment mechanism 618 along/within the corresponding slot 640.

Figure 23:
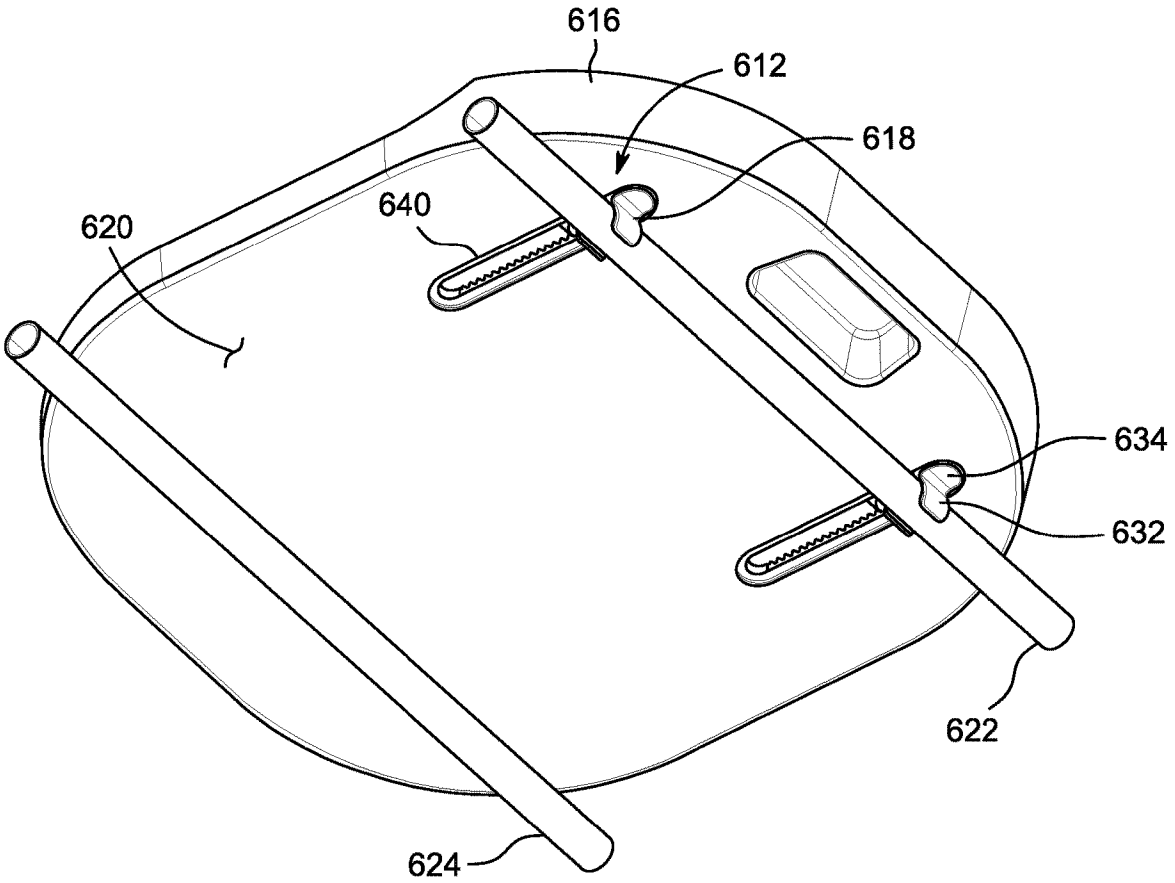
FIG. 23 is a bottom perspective view of another exemplary user assist seat and walker connection system in an engaged state with cross members of an exemplary walker.
Figure 24:
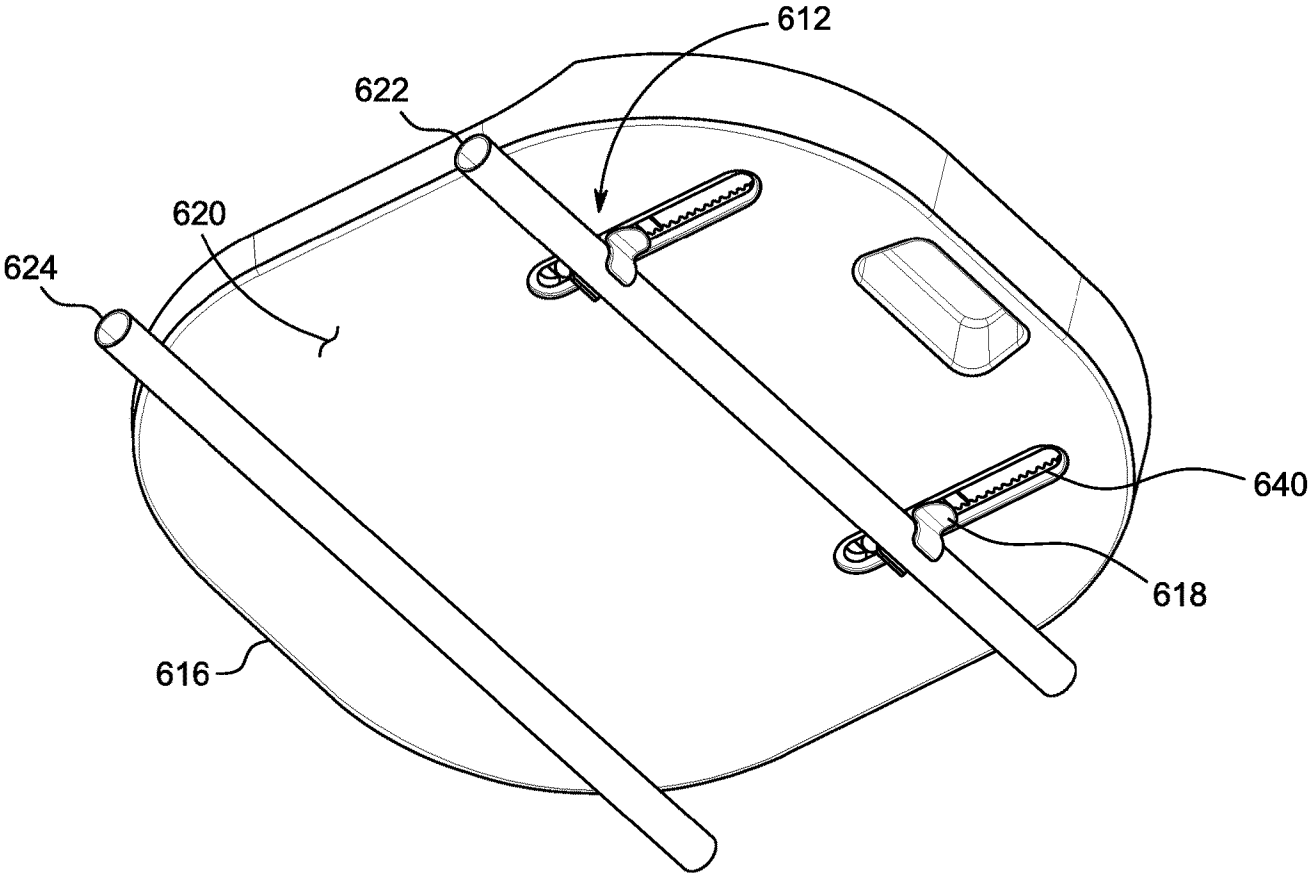
FIG. 24 is a bottom perspective view of the exemplary user assist seat and walker connection system of FIG. 20 in an engaged state with cross members of another exemplary walker.

The nut or screw 668 may also assist in preventing movement of the attachment mechanism 618 within the corresponding slot 640. The nut or screw 668 may be threadably engaged with the base portion 634 such that rotation of the nut or screw 668 draws the nut or screw 668 and the base portion 634 together or apart toward depending upon the direction of rotation. Rotation of the base portion 634 may be prevented as it may be captured within a recess about the slot 640. In this way, the nut or screw 668 may be rotated or tightened to exert a clamping force to the cap 666 against the top side 628 of the base 616 (e.g., mating the surface textures 670 of the cap 666 and the base 616) and the base portion 634 against the bottom side 620 of the base 616 about the slot 640 (e.g., a recess about the slot 640) to fix the attachment mechanism 618 in a particular location along/within the slot 640. The nut or screw 668 may be loosened from such an arrangement to allow slack or a gap between the cap 666 and the top side 628 of the base 616 and the base portion 634 against the bottom side 620 of the base 616 so that the attachment mechanism 618 can be manually translated along the slot 640 to a desired location, as shown in FIG. 23 verse FIG. 24. Further, the nut or screw 668 may be loosened such that it disconnects from the base portion 634 and flexible clip portions 632 to allow the attachment mechanism 618 to be removed from the base 616 (i.e., the assist seat), as shown in FIG. 26.

Figure 29:
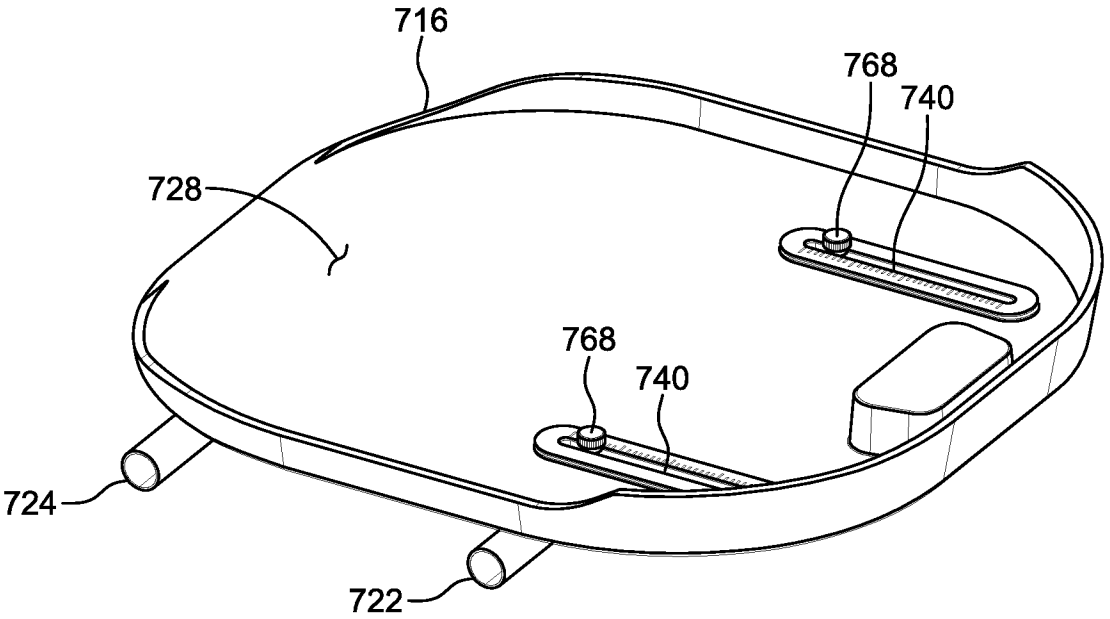
FIG. 29 is a top perspective view of the exemplary user assist seat and walker connection system of FIG. 28 in the engaged state.
Figure 30:
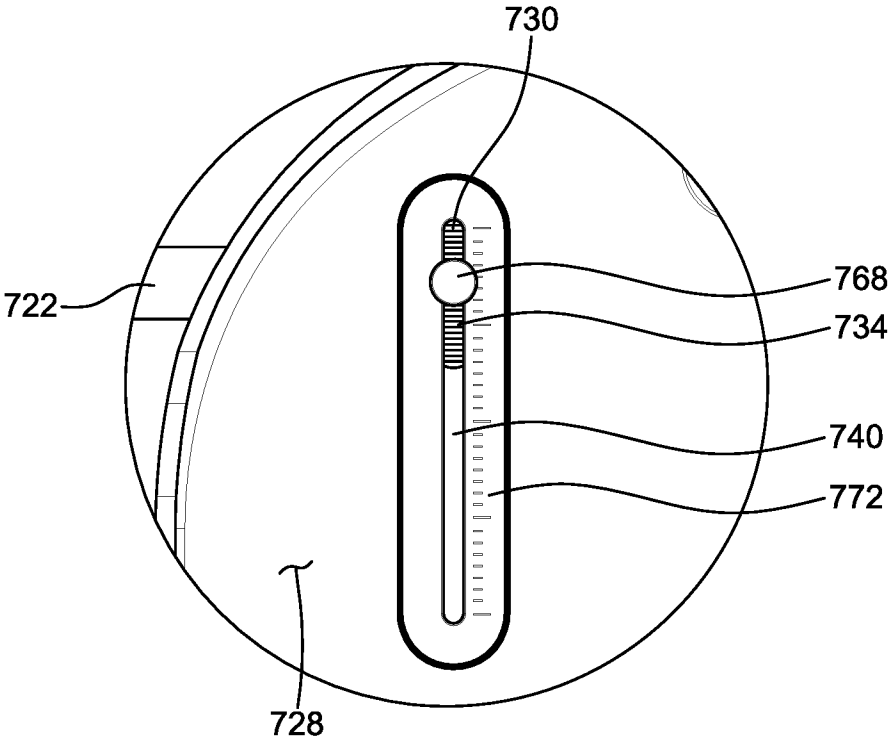
FIG. 30 is an enlarged top view of a portion of the exemplary user assist seat and walker connection system of FIG. 28 in the engaged state.
Figure 31:
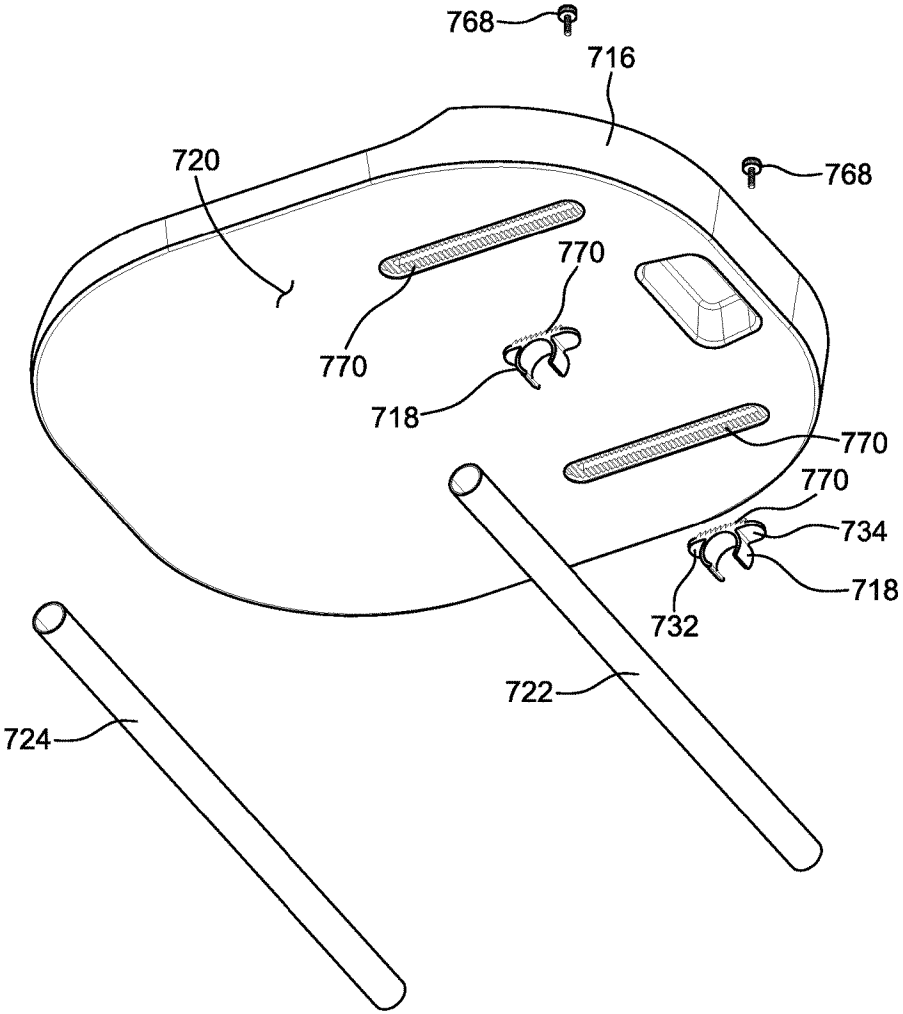
FIG. 31 is an exploded perspective view of the exemplary user assist seat and walker connection system of FIG. 27.

FIGS. 27-31 illustrate another connector system 712 according to the present disclosure. The connector system 712 of FIGS. 27-31 is similar to the connector system 512 of FIGS. 20-22 is similar to the connector system 12 of FIGS. 7-11, the connection system 212 of FIG. 12, the connector system 312 of FIGS. 13-16, the connector system 412 of FIGS. 17-19 and the connector system 512 of FIGS. 20-22 and the connector system 612 of FIGS. 23-26 described above, and therefore like reference numerals preceded with "7" are used to indicate like aspects, processes or functions, and the description above directed to aspects, processes or functions thereof (and the alternative embodiments thereof) equally applies to the connector system 712. As shown in FIGS. 27-31, the connector system 712 is substantially similar to the connector system 612 of FIGS. 23-26 described above. As shown in FIGS. 27-31, the connector system 712 includes surface texture or ridges 770 about or adjacent to the underside of the slots 740 for engagement with surface texture or ridges 770 formed on the top or upper side of the base portions 734 of the engagement mechanisms 718, as shown in FIGS. 27, 28, 30 and 31. Further, the nut or screw 668 acts directly on the top or upper side surface 628 of the base 616, as shown in FIGS. 29 and 30. As shown in FIG. 30, in some embodiments a visual and/or tactile indication 672 is provided proximate to the top or upper side of each slot 740 that indicates the relative position of the engagement mechanism 618 provided therein.

It is to be understood that the above description is intended to be illustrative, and not restrictive. Numerous changes and modifications may be made herein by one of ordinary skill in the art without departing from the general spirit and scope of the invention as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably connected" is used herein to refer to both connections resulting from separate, distinct components being directly or indirectly coupled and components being integrally formed (i.e., monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A walker, comprising:

a frame comprising a plurality of leg portions extending between ground engagement portions and handle portions, and front and rear cross-members;

a user assist seat comprising a base, an engagement portion pivotably coupled to the base for engaging a user sitting thereon, and a lifting mechanism configured to provide an assist force to the engagement portion that pivotably biases the engagement portion upward from the base; and at least one attachment mechanism that removably and rotatably couples the base of the user assist seat to at least one of the front and rear cross-members.

2. The walker of claim 1, wherein the at least one attachment mechanism is removably coupled to the base of the user assist seat.

3. The walker of claim 2, wherein an underside of the base of the user assist seat comprises a substantially planar surface when the at least one attachment mechanism is decoupled from the base.

4. The walker of claim 2, wherein the at least one attachment mechanism extends through an aperture in the base and comprises a base portion positioned on an underside of the base and a nut portion rotatable coupled with the base portion positioned on a top side of the base to removably couple the at least one attachment mechanism and the assist seat.

5. The walker of claim 4, wherein the aperture in the base is of a non-circular shape, and wherein the nut portion of the at least one attachment mechanism is the same shape as the aperture.

6. The walker of claim 4, wherein the base includes a plurality of apertures.

7. The walker of claim 4, wherein the aperture is a slot.

8. The walker of claim 7, wherein a portion of the base adjacent to the slot on at least one of the underside and top side of the base includes a surface texture of ridges.

9. The walker of claim 1, wherein the at least one attachment mechanism includes a pair of finger portions independently slidable within a slot in the underside of the base of the assist seat.

10. The walker of claim 1, wherein the at least one attachment mechanism includes an engagement member that is slidable within a slot in the underside of the base of the assist seat, and wherein the underside of the base of the assist seat includes at least one recesses configured to accept at least one of the front and rear cross-member therein.

11. The walker of claim 1, wherein the at least one attachment mechanism comprises a mount with at least one outwardly biased tab with a lip, and wherein the base includes an aperture configured to accept the mount therein such that the lip engages the base.

12. The walker of claim 1, wherein the at least one attachment mechanism includes flexible portions configured to removably couple to the at least one of the front and rear cross-members.

13. The walker of claim 1, wherein the at least one attachment mechanism removably and rotatably couples the base of the user assist seat to the front cross-member, and wherein an underside of the base rests upon the rear cross-member.

14. The walker of claim 1, wherein the walker is a rollator type walker with at least one of the ground engagement portions comprising a wheel.

15. The walker of claim 1, wherein the front cross-member extends between left and right front leg portions, and the rear-cross member extends between left and right rear leg portions.

16. A universal user assist seat for use with walkers and seating substrates, comprising:

a base portion;

an engagement portion pivotably coupled to an upper surface of the base for engaging a user when a user sits thereon;

a lifting mechanism that provides an assist force to the engagement portion that biases the engagement portion in an upward position from the base; and at least one attachment mechanism configured to removably and rotatably couple the base of the user assist seat to at least one of a front cross-member and a rear cross-member of a frame of a walker.

17. The universal user assist seat of claim 16, wherein the at least one attachment mechanism is removably coupled to the base of the user assist seat.

18. The universal user assist seat of claim 17, wherein an underside of the base of the user assist seat forms a substantially planar surface when the at least one attachment mechanism is decoupled from the base for use with a seating substrate.

19. The universal user assist seat of claim 17, wherein the at least one attachment mechanism extends through an aperture in the base and comprises a base portion positioned on an underside of the base and a nut portion rotatable coupled with the base portion positioned on a top side of the base to removably couple the at least one attachment mechanism and the assist seat.

20. The universal user assist seat of claim 19, wherein the aperture in the base is of a non-circular shape and the nut portion of the at least one attachment mechanism is the substantially the same shape as the aperture, and wherein the base includes a plurality of apertures.

* * * * *